US012486769B2

(12) United States Patent
Matthews et al.

(10) Patent No.: US 12,486,769 B2
(45) Date of Patent: Dec. 2, 2025

(54) DOLLY FOR ROCKBOLT

(71) Applicant: FCI Holdings Delaware, Inc., Wilmington, DE (US)

(72) Inventors: Jason Matthews, Smeaton Grange (AU); Matthew Holden, Smeaton Grange (AU)

(73) Assignee: FCI Holdings Delaware, LLC, Wilmington, DE (US)

( * ) Notice: Subject to any disclaimer, the term of this patent is extended or adjusted under 35 U.S.C. 154(b) by 0 days.

(21) Appl. No.: 18/688,046

(22) PCT Filed: Jun. 2, 2023

(86) PCT No.: PCT/AU2023/050478
§ 371 (c)(1),
(2) Date: Feb. 29, 2024

(87) PCT Pub. No.: WO2023/230670
PCT Pub. Date: Dec. 7, 2023

(65) Prior Publication Data

US 2024/0360760 A1 Oct. 31, 2024

(30) Foreign Application Priority Data

Jun. 3, 2022 (AU) ..... 2022901533

(51) Int. Cl.
*E21D 21/00* (2006.01)
*E21D 20/00* (2006.01)

(52) U.S. Cl.
CPC ..... *E21D 21/0053* (2016.01); *E21D 20/003* (2013.01); *E21D 21/008* (2013.01); *E21D 21/0086* (2013.01); *E21D 21/0093* (2013.01)

(58) Field of Classification Search
CPC ..... E21D 21/008; E21D 21/0086; E21D 21/0093; E21D 21/0053; E21D 20/003
See application file for complete search history.

(56) References Cited

U.S. PATENT DOCUMENTS 4,127,000 A 11/1978 Montgomery, Jr. et al.
11,002,135 B2 * 5/2021 Pastorino ..... E21D 20/025
(Continued)

FOREIGN PATENT DOCUMENTS

AU 2013101106 A4 * 11/2013
AU 2021105904 A4 10/2021
(Continued)

*Primary Examiner* — Kyle Armstrong
(74) *Attorney, Agent, or Firm* — The Webb Law Firm

(57) ABSTRACT

A rock bolt dolly for connecting a self-drilling rock bolt to a rock bolting apparatus includes a drive shaft having a central bore and defining a proximal end and a distal end defining an engagement means for engagement with a corresponding engagement means located on the proximal end of the rock bolt. A sleeve is mounted over the distal end of the drive shaft and arranged to slide along and over the drive shaft and defines a female engagement means at a distal end, for engaging with a nut threaded onto the proximal end of the rock bolt. The interior of the sleeve and exterior of the drive shaft are configured to rotate together about their central axis. A spring biases the distal end of the sleeve away from the distal end of the drive shaft. The dolly operates in two modes, one in which the nut and rod rotate together, and a second where the nut rotates on the rod.

19 Claims, 16 Drawing Sheets

(56) References Cited

U.S. PATENT DOCUMENTS

| | | | | |
|---|---|---|---|---|
| 2010/0230909 | A1 | 9/2010 | Bayerl et al. | |
| 2013/0129425 | A1 | 5/2013 | Horsch | |
| 2020/0011177 | A1 * | 1/2020 | Pastorino | E21D 20/003 |

FOREIGN PATENT DOCUMENTS

| | | | | |
|---|---|---|---|---|
| WO | WO-2011026180 | A1 * | 3/2011 | E21D 21/008 |
| WO | 2012012401 | A2 | 1/2012 | |
| WO | 2012015349 | A1 | 2/2012 | |
| WO | WO-2021056062 | A1 * | 4/2021 | E21D 21/008 |

* cited by examiner

DOLLY FOR ROCKBOLT

CROSS-REFERENCE TO RELATED APPLICATIONS

This application is the United States national phase of International Patent Application No. PCT/AU2023/050478 filed Jun. 2, 2023, and claims priority to Australian Provisional Patent Application No 2022901533 filed Jun. 3, 2022, the disclosures of which are incorporated herein by reference in their entireties.

BACKGROUND OF THE INVENTION

Field of the Invention

This invention relates to a dolly for use in installing a rockbolt and to an associated system for and method of installing rock bolts, particularly self-drilling rock bolts.

Description of Related Art

Rock bolts are used in soft and hard underground mines to provide ground support for mined excavations, and in particular are used to support mine walls and roofs.

One commonly used method of installing rock bolts involves using a self-drilling rock bolt which uses a sacrificial drill bit attached to a hollow rock bolt. This allows rock bolts to be used in poor ground conditions where the self-drilling rock bolt acts as the drill steel and remains in the borehole after drilling. The applicants have previously filed an Australian innovation patent AU2021105904 for a self-drilling rock bolt, the entire contents of which are incorporated by reference. The self-drilling rockbolt consists of a self-drilling hollow bar with a mechanical anchor in the form of an expansion shell that is activated after drilling. The mechanical anchor is activated by any attempt to pull the bar out of the hole. This can be used to pre-tension the rockbolt with the use of a nut and bearing plate located over the rock face.

To install such a self-drilling rockbolt as described in AU2021105904 requires two stages, or drilling equipment with multiple arms, first to drill and then to pre-tension the bolt. The present invention aims to speed up installation of such bolts.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY OF THE INVENTION

Thus according to a first aspect of the present invention, there is provided rock bolt dolly for connecting a self-drilling rock bolt to a rock bolting apparatus, such as a drifter, rock drill or the like, and arranged to transfer torque and optionally percussive energy, applied to the dolly by the rock bolting apparatus to the rock bolt during installation of the rock bolt, the rock bolt including an externally threaded rod having a proximal end and a distal end defining a drill bit, the dolly defining a coupling means at its proximal end for engagement with the rock bolting apparatus, the dolly further comprising:

a drive shaft having a central bore and defining a proximal end and a distal end, the drive shaft defining an engagement means at the distal end for engagement with a corresponding engagement means located on or defined on the proximal end of the rock bolt;

a sleeve mounted over the distal end of the drive shaft and arranged to slide along and over the drive shaft and defining a female engagement means at its distal end, for engaging with a nut or the like threaded onto the proximal end of the rock bolt, the interior of the sleeve and exterior of the drive shaft being configured such that the drive shaft and sleeve rotate together about their central axis, and a biasing means for biasing the distal end of the sleeve away from the distal end of the drive shaft;

the arrangement being such that in a first mode, with the biasing means compressed, the engagement means of the drive shaft is engaged with the corresponding engagement means located on or defined on the proximal end of the rock bolt, and the female engagement means of the sleeve is engaged with the nut or the like threaded onto the proximal end of the rock bolt so that the dolly rotates the rod and nut together such that the nut does not translate along the rod, and in a second mode, with the biasing means expanded, the engagement means of the drive shaft is disengaged with the corresponding engagement means and the female engagement means of the sleeve is engaged with the nut or the like and the dolly rotates the nut only which translates along the externally threaded rod of the rock bolt.

Thus in the first mode, the rock bolt can be drilled into a rock face with the drill bit creating a bore hole and the nut, and an associated bearing plate remain at the proximal end of the rock bolt as the rod is rotated simultaneously at the same angular speed as the nut. Drilling is terminated once the bearing plate contacts the rock face and the rock bolting apparatus is retracted which allows the biasing means to expand and the engagement means of the drive shaft is dis-engaged from the corresponding engagement means located on or defined on the proximal end of the rock. When rotation is applied by the rock bolting apparatus only the nut is engaged and translates along the rod and the rod does not rotate and this retracts the distal end of the rod causing the expansion of the shell by the drill bit which in turn applies tension to the rock bolt. The dolly can then be disconnected and post-grouting can occur.

In a preferred embodiment, the exterior of the main body portion of the drive shaft is polygonal, preferably hexagonal, and the sleeve defines a correspondingly shaped polygonal aperture in which the main body portion locates and can slide.

It is preferred that a bore extends through the dolly to allow the passage of fluids such as water for flushing fines, liquid grout or the like.

Typically, the biasing means comprises a spring, typically a compression spring.

In one embodiment, the corresponding engagement means located on or defined on the proximal end of the rock bolt comprise an adaptor mounted on the proximal end of the rock bolt, typically defining a hex drive.

In another embodiment the corresponding engagement means located on or defined on the proximal end of the rock bolt comprise a hex drive machined onto the rod of the rock bolt.

A second aspect of the present invention provides a rock bolt for use with the rock bolt dolly comprising:

an elongate rod having a central bore and being externally threaded, the rod having a first or distal end and a second or proximal end wherein the proximal end of the rod defines an engagement means for engagement with a corresponding engagement means of the rock bolt dolly, for rotating the rod of the rock bolt about its central axis during installation;

a drill bit mounted on the distal end for drilling a bore in strata such as rock or the like wherein the sides of the drill bit taper outwardly towards the cutting end of the drill at an angle of from about 1 to 10°;

an expansion shell mounted about the exterior of the rod adjacent the drill bit, the shell defining at least one longitudinal slot to allow the shell to expand and contract;

a stop for maintaining the expansion shell in close proximity to the drill bit and limiting the movement of the expansion shell towards the proximal end of the rock bolt;

wherein the exterior of the shell is contoured to define a series of ridges or the like and wherein the widest part of the shell is wider than the drill bit and wherein the interior of the shell is wider than the exterior of the elongate rod to allow the rod to rotate relative to the shell and wherein the shell is free to rotate relative to the drill bit, and is tapered inwardly towards the proximal end;

an engagement means for rotating the elongate rod fixed on or defined at a proximal end of the rock bolt, and being fixed to the rod such that rotation of the engagement means causes rotation of the elongate rod;

the arrangement being such that as the rock bolt is installed in strata, the drill bit forms a bore in the strata and the shell tends to drag along the bore wall when thrust forward during drilling and remains largely clear of the spinning rod and drill bit and when drilling ceases, movement of the rock bolt out from the bore causes the drill bit to engage with and expand the shell.

In one embodiment, the corresponding engagement means located on or defined on the proximal end of the rock bolt comprise an adaptor mounted on the proximal end of the rock bolt, typically defining a hex drive.

In another embodiment the corresponding engagement means located on or defined on the proximal end of the rock bolt comprise a male or female hex drive machined onto the proximal end of the rod of the rock bolt.

The invention also envisages a method of installing a self-drilling rock bolt according to the second aspect in a rock face, using a rock bolt dolly according to the first aspect comprising the steps of:

mounting the rock bolt to the rock bolt dolly;

inserting the nut or the like threaded onto the proximal end of the rock bolt into the female engagement means of the sleeve;

pushing the distal end of the rock bolt defining a drill bit against the rock face until, with the biasing means compressed, the engagement means of the drive shaft is engaged with the corresponding engagement means located on or defined on the proximal end of the rock bolt;

applying rotation and optionally percussion to the rock bolt dolly to drill the rock bolt into the rock face using the drill bit rotating both the nut and the rod of the rock bolt;

terminating drilling after a bearing plate located on the proximal end of the rock bolt contacts the rock face;

retracting the rock bolting apparatus to disengage the engagement means of the drive shaft from the corresponding engagement means located on or defined on the proximal end of the rock bolt; and with the nut or the like threaded onto the proximal end of the rock bolt still engaged with the female engagement means of the sleeve due to the biasing means, rotating the dolly, in the same direction as during drilling, to rotate the nut along the rod of the rock bolt which pulls the distal end of the rock bolt back towards the rock face/bearing plate and causes the expansion shell of the rock bolt to expand and tension is applied to the rock bolt Typically, during drilling, a central bore in the drive shaft is used to transmit fluid for flushing fines out of the bore, and for cooling.

The invention also envisages a method of installing a self-drilling rock bolt in a rock face, using the rock bolt dolly, in an extension drilling process, comprising the steps of:

a) mounting a starter rock bolt to the rock bolt dolly, the starter rock bolt comprising:

an elongate rod having a central bore and being externally threaded, the rod having a first or distal end and a second or proximal end;

a drill bit mounted on the distal end for drilling a bore in strata such as rock or the like wherein the sides of the drill bit taper outwardly towards the cutting end of the drill at an angle of from about 1 to 10°, preferably about 5°;

an expansion shell mounted about the exterior of the rod adjacent the drill bit, the shell defining at least one longitudinal slot to allow the shell to expand and contract;

a stop for maintaining the expansion shell in close proximity to the drill bit and limiting the movement of the expansion shell towards the proximal end of the rock bolt;

wherein the exterior of the shell is contoured to define a series of ridges or the like and wherein the widest part of the shell is wider than the drill bit and wherein the interior of the shell is wider than the exterior of the elongate rod to allow the rod to rotate relative to the shell and wherein the shell is free to rotate relative to the drill bit, and is tapered inwardly towards the proximal end; and an engagement means for rotating the elongate rod located on or defined at or near a proximal end of the rock bolt, corresponding to the engagement means defined on the distal end of the drive shaft; wherein the step of mounting includes engaging the corresponding engagement means of the starter bar with the engagement means defined on the distal end of the drive shaft;

b) pushing the drill bit of the starter rock bolt defining against the rock face and applying rotation to the rock bolt dolly to drill the rock bolt into the rock face using the drill bit;

c) terminating drilling after the sleeve of the dolly nears the rock face;

d) retracting the rock bolting apparatus to disengage the engagement means of the drive shaft from the corresponding engagement means located on or defined on the proximal end of the starter rock bolt;

e) mounting either an extension bar having a coupler mounted on the distal end of the extension bar, or a finisher bar, to the dolly;

f) optionally where an extension bar is used, engaging an engagement means for rotating the extension bar located on or defined at or near a proximal end of the extension bar, with the engagement means defined on the distal end of the drive shaft, aligning the extension bar with the starter bar or a previous extension bar connecting the bars using the coupler and drilling the rock bolt further into the rock face using a combination of rotation and feed pressure and terminating drilling after the sleeve of the dolly nears the rock face;

g) optionally repeating step f) one or more times with one or more further extension bars;

h) mounting a finisher bar to the rock bolt dolly, the finisher bar including an engagement means for rotating the elongate rod of the finisher bar located on or defined at or near a proximal end of the rock bolt, corresponding to the engagement means defined on the distal end of the drive shaft; wherein the step of mounting includes engaging the corresponding engagement means of the starter bar with the engagement means defined on the distal end of the drive shaft, the finisher bar also including a nut or the like threaded onto the proximal end of the rock bolt which is inserted into the female engagement means of the sleeve and further defining a coupler on its distal end;

i) aligning the finisher bar with the starter bar or a previous extension bar, connecting the bars using the coupler and drilling the rock bolt further into the rock face using a combination of rotation and feed pressure and terminating drilling after the sleeve of the dolly or bearing plate associated with the nut nears the rock face;

j) disengaging the drive shaft from the finisher bar; and h) with the nut or the like threaded onto the proximal end of the finisher bar still engaged with the female engagement means of the sleeve, rotating the dolly, in the same direction as during drilling, to rotate the nut along the rod of the finisher bar which pulls the distal end of the starter bar back towards the rock face/bearing plate and causes the expansion shell of the starter bar to expand and tension to be applied to the rock bolt.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF THE DRAWINGS

The terms Fig., Figs., Figure, and Figures are used interchangeably in the specification to refer to the corresponding figures in the drawings.

Specific embodiments of the present invention will now be described, by way of example only, and with reference to the accompanying drawings, in which:—

DESCRIPTION OF THE INVENTION

Figure 1:
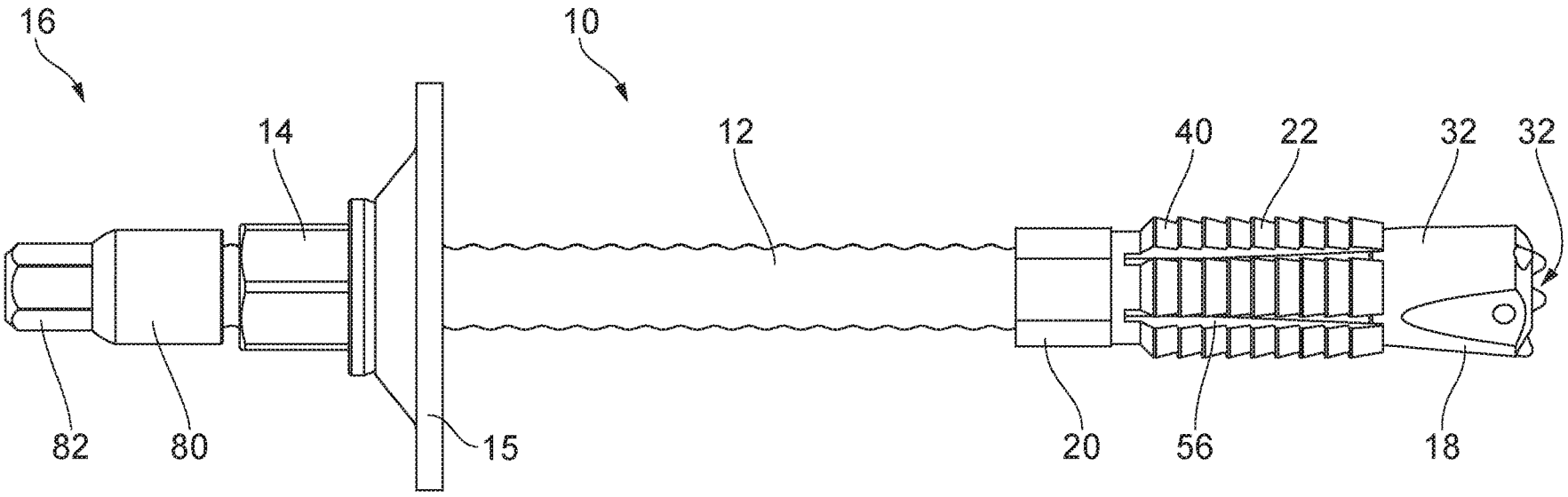
FIG. 1 shows a self-drilling rock bolt.

Referring to the drawings, FIG. 1 shows a self-drilling rock bolt 10. The rock bolt 10 comprises an elongate hollow rod/bar 12 having a central bore (not shown) and an external R32 thread which is industry standard, although the dimensions and thread on the bar could be varied. The rod/bar will typically be made from steel. An R32 hexagonal nut 14 and bearing plate 15 is threaded onto the proximal end 16 of the rod. In the described embodiment, an R32 button head drill bit 18 with an internal R32 thread is mounted on the distal end of the rock bolt, although other types of drill bits and configurations may be employed. An expansion shell 22, described in more detail below, is located on the rod 12 between the drill bit 18 and a stop 20.

The R32 button head drill bit 18 has a drilling end 30 for drilling through strata, typically rock, and has an external side surface 32 which is tapered outwardly from the threaded end to the bit end at an angle of 5° relative to the longitudinal axis of the rock bolt.

The shell 22 has a generally annular cross section. The exterior of the shell is serrated defining a series of ridges in the form of wedges 40. The exterior diameter of the shell is oversized compared to the exterior diameter of the drill bit 30 and the bore hole formed by the drill bit 30 in use.

The interior surface of the shell has a greater diameter than the external diameter of the R32 bar so that the shell floats on the bar and the bar can rotate/spin relative to the shell 22. The interior surface of the shell has a 5° taper relative to the longitudinal axis of the rock bolt and expands outwards towards the distal end of the rock bolt.

The shell defines a channel in the form of an elongate slot which extends the full length of the shell allowing the shell to expand and compress. Five additional channels in the form of partial slots 56 are provided also, which help to reduce the force required to compress the shell, and allow for the clearing of fines, as discussed below. The channels also allow for the flow of a settable material, such as resin or grout, after the bore has been drilled.

As shown in FIG. 1, a drive adaptor 80 is mounted on the proximal end of the bar adjacent the hex nut 14. The drive adaptor defines a male engagement means in the form of a hexagon or hexagonal nut 82 for engaging with a corresponding female engagement means in the form of a hexagonal socket. As an alternative to the drive adaptor, a hexagon may be formed directly on the bar, by machining or the like. This is described below in more detail with reference to FIG. 10.

Figure 2:
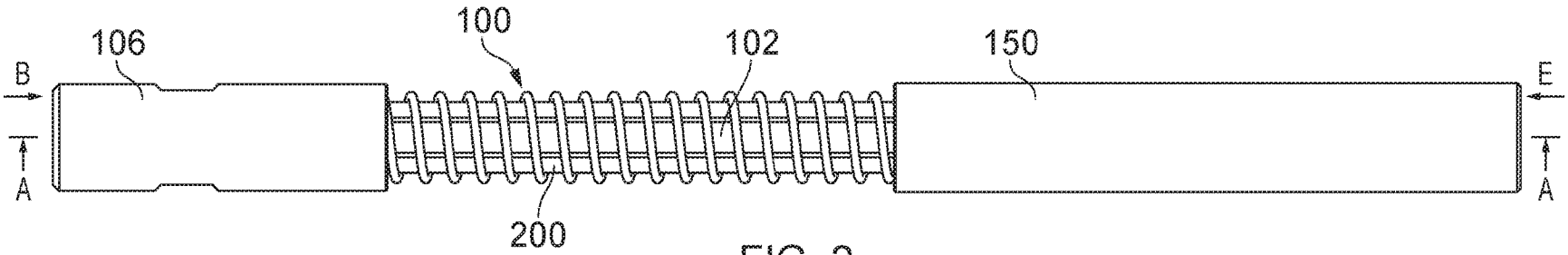
FIG. 2 shows a rock bolt dolly.
Figure 3:
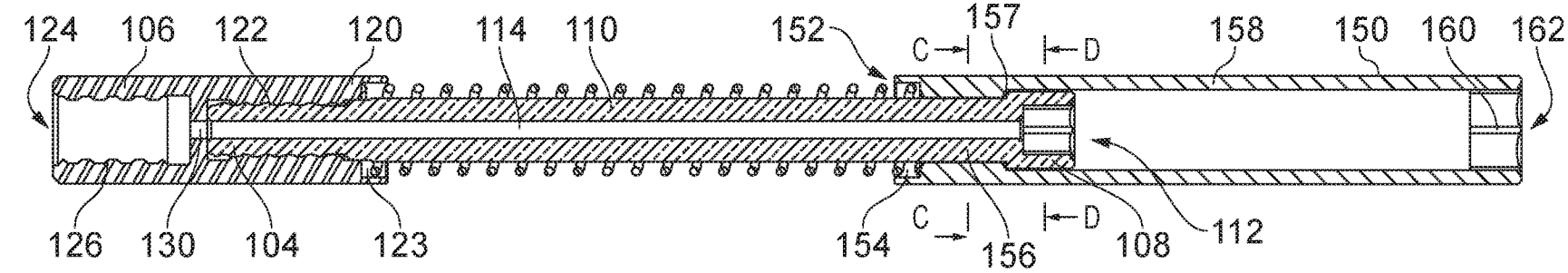
FIG. 3 shows a section through the dolly on A-A shown in FIG. 2.
Figure 7:
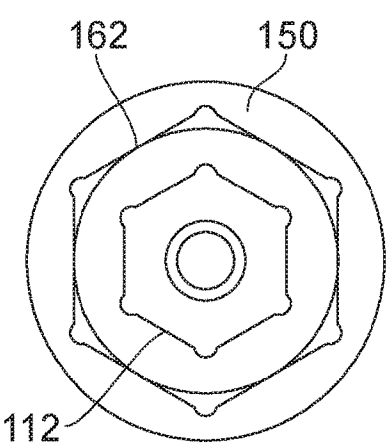
FIG. 7 shows an enlarged end view of the dolly from the direction E.
Figure 6:
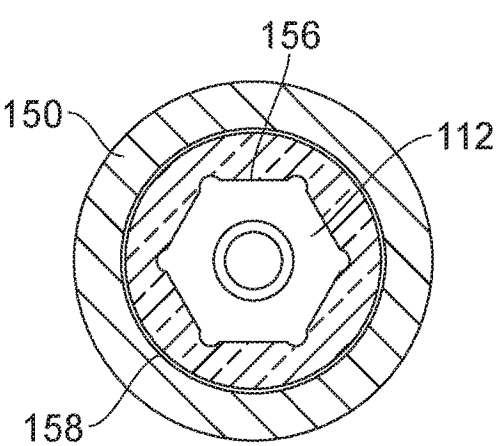
FIG. 6 shows section through the dolly on D-D shown in FIG. 2.
Figure 5:
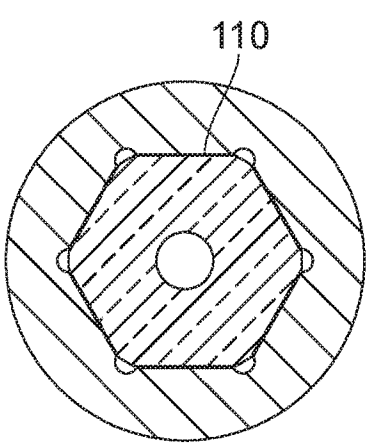
FIG. 5 shows a section through the dolly on C-C shown in FIG. 2
Figure 4:
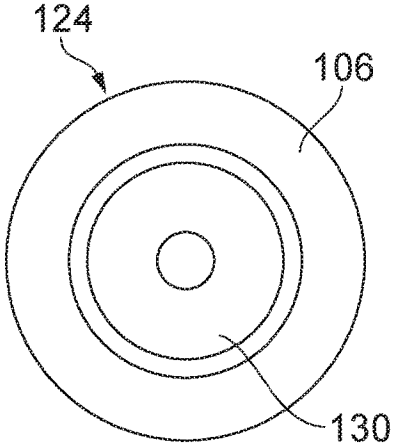
FIG. 4 shows an enlarged end view of the dolly from the direction B.
Figures 8A, 8B, 8C, 8D, 8E, 8F, 8G:
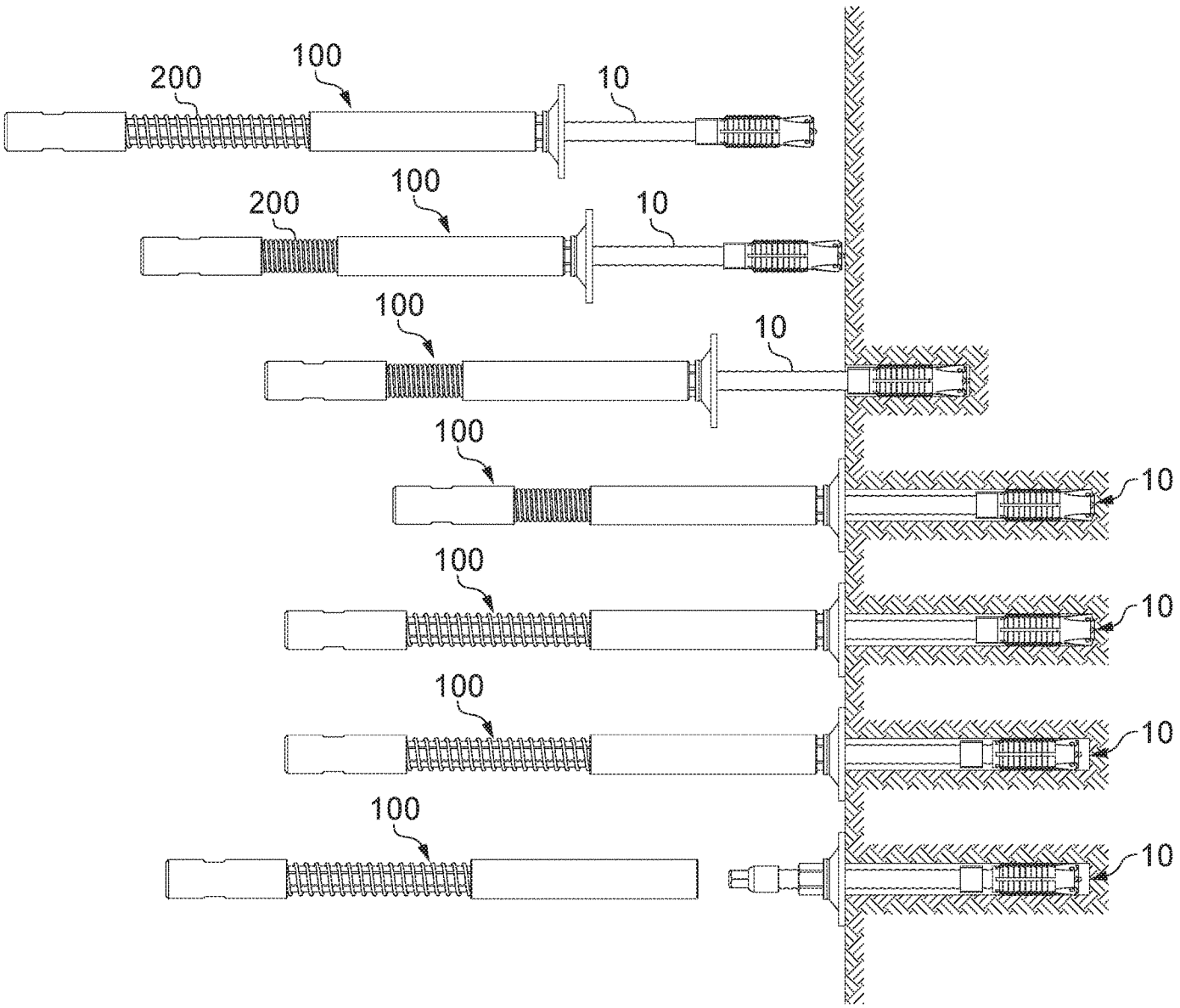
FIGS. 8*a* to 8*g* show various stages in the installation of the self-drilling rock bolt of FIG. 1, using the dolly shown in FIGS. 2 to 7.

FIGS. 2 to 7 show a dolly 100 for use in installing the rock bolt shown in FIG. 1. The dolly includes an elongate drive shaft 102. One end 104 of the drive shaft 102 is externally threaded and fixed to a shank adaptor 106. As is best seen in FIG. 2, the other end 108 is enlarged relative to the main body portion 110 of the drive shaft and defines a hollow hexagonal drive socket 112 for receiving a hexagonal drive nut 82 of the rock bolt or a drive adaptor 80 attached to the rock bolt. A bore 114 extends from one end of the drive shaft to the other. The exterior of the main body portion 110 of the drive shaft 102 has a hexagonal cross-section, as is best seen in FIGS. 2 and 5.

The shank adaptor 106 has one end 120 which defines an internally threaded bore 122 which is threaded onto the corresponding externally threaded end 104 of the drive shaft 102 and an annular recess 123 for receiving the end of a spring 200. The opposite end 124 also defines an internally threaded bore 126 which is configured to mate with the drive shaft of a rock bolting apparatus, such as a bolter ram or the like, which will typically be a T38 or T45 thread. A bore 130 connects the two ends of the drive shaft.

A tubular sleeve or sliding outer body 150 is mounted over the other end of the drive shaft 102. A first or proximal end of the sleeve 152 defines a shallow annular channel or circular recess 154 for receiving a biasing means in the form of a compression spring 200 and then narrows to define an internal bore 156 which is hexagonal and slightly larger than the external diameter of the main body portion 110 of the drive shaft so that it can slide along the exterior of the drive shaft. The bore widens out at a step 157 to define a wider cylindrical bore 158 which extends for the remaining length of the sleeve to its distal end 160 which defines a hexagonal socket 162.

The compression spring 200 is mounted around the exterior of the drive shaft 102 and its ends are located in the recesses 154 and 123 respectively and biases the sleeve 150 away from the shank adaptor 106.

The use of the dolly 100 to install a rock bolt 10 will now be described with reference to FIGS. 8*a* to 9*g*. First with reference to FIGS. 8*a* and 9*a*, the bolt 10 is mounted to the dolly 100, either manually or using a mechanised bolting carousel. The male hex nut 14, which is threaded onto the bar and free to rotate, inserts into the female hex socket 162 located at the front of the tubular sleeve 150 of the dolly.

Figures 9A, 9B, 9C, 9D, 9E, 9F, 9G:
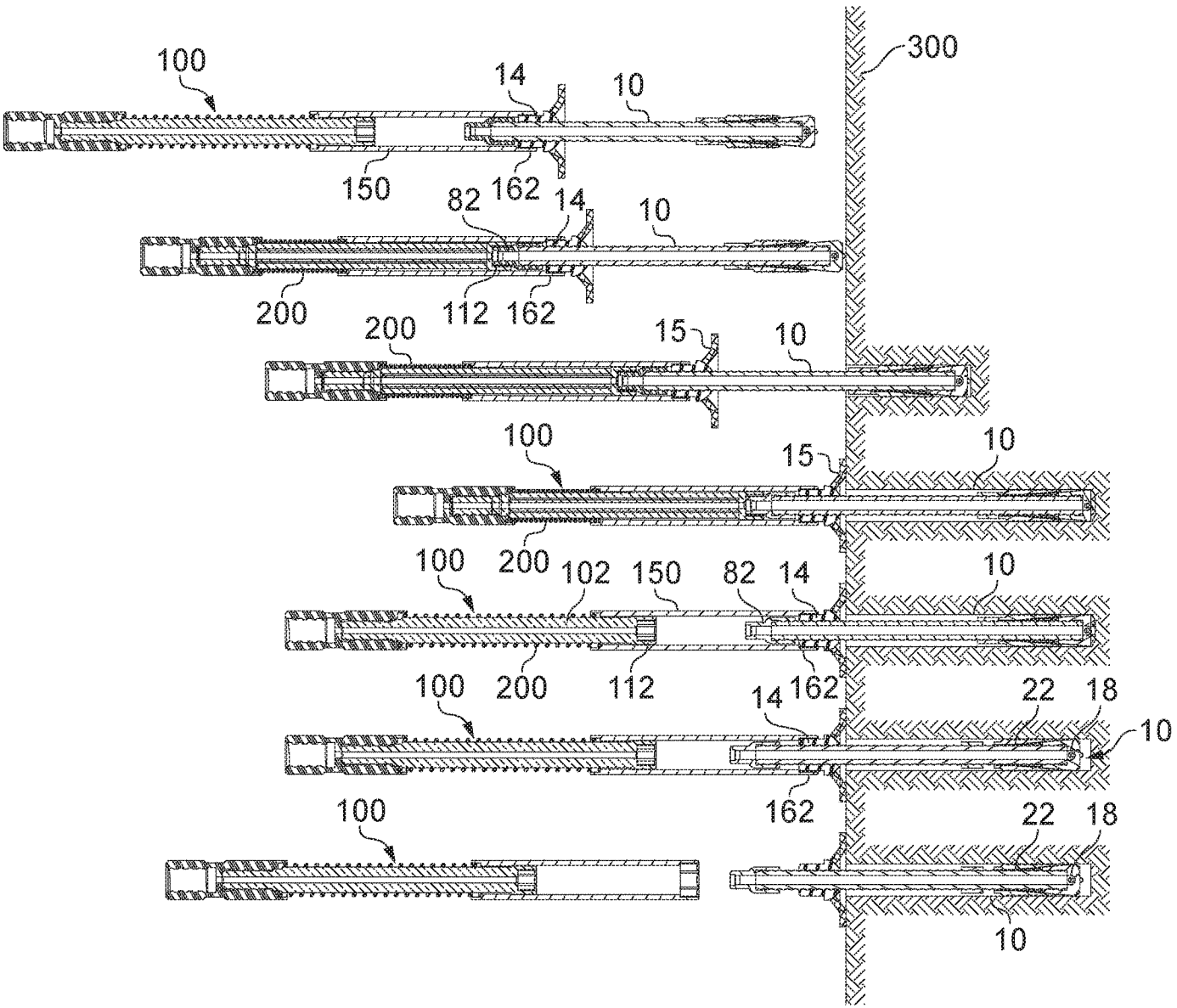
FIGS. 9*a* to 9*g* show cross-sections through the various stages shown in FIGS. 8*a* to 8*g*.

The bolt 10 is then pushed against the rock face using the drifter/drill motor (not shown), and the drive shaft 102 is forced forward until the hexagonal socket 112 engages with the nut 82 of the drive adaptor 80, as is best seen in FIG. 9*b*. The compression spring 200 is compressed between the sleeve 150 and the shank adaptor 106 which preloads the sliding outer body 150 against the hex nut 14. The exposed spring 200 provides visual feedback to the operator indicating whether the drive adaptor is properly engaged with the drive shaft or not. In a variant, not shown, the spring may be covered by a dust cover which may be transparent.

The bolt is drilled into the rock mass either using a combination of percussion and rotation or just torque/rotation only. FIG. 9*c* shows the rock bolt 10 part drilled into the rock mass. During drilling, the interlocking geometry between the sliding outer body, drive shaft and hex nut 14 restrict the free, or lightly affixed, hex nut 14 from translating along the bar. That is because the sleeve 150 and drive shaft 102 rotate at the same angular rotation and in turn rotate the hex nut 14 via the socket 162 and the threaded bar 12 via the drive adaptor 80 and hex nut 82 together at the same angular rotation. Hence the nut 14 does not translate along the rod 102, as it rotates with the rod 12. Once the bearing plate 15 encounters the rock face 300, as shown in FIG. 9*d*, drilling is stopped.

With reference to FIG. 9*e*, the drill motor is then retracted, which causes the drive shaft 102 to disengage from the hex nut 82 and drive adaptor 80. During retraction, the preload from the compression spring 200 maintains engagement of the sleeve 150 and in particular the socket 162 with the hex nut 14. The operator ceases retraction of the drifter/drill motor when the drive shaft reaches its fully retracted position, shown in FIG. 9*e*. The sleeve 150 remains engaged with the hex nut 14 when the drive shaft is fully retracted.

With the drive shaft 102 retracted and the sleeve 150 still engaged with the hex nut 14, rotation is applied to the drill motor in the same direction as drilling. This causes the socket 162 of the sleeve 150 to rotate the hex nut 14, which in turn winds along the threaded rod 12 and pulls the bolt out of the drill-hole. The act of pulling the bolt out of the drill-hole pulls the drill bit 18 towards the proximal end of the bolt 10 which in turn activates and expands the expansion shell 22 against the wall of the bore and applies tension to the bolt.

With reference to FIG. 9*f*, the drill motor is rotated until it stalls which indicates that the bolt 10 has been tensioned. The geometry of the sliding outer body and the drive shaft allow sufficient clearance to prevent interference between the drive shaft and the end of the bolt as it pulls out of the drill-hole.

The dolly 100 is then fully retracted, and post-grouting can commence. Typically, a grouting system separate to the dolly is used to inject grout through the bore of the rock bolt. The grout may be any suitable material but will typically be either cementitious or polymeric to suit ground conditions and/or the requirements of the system.

Figure 10:
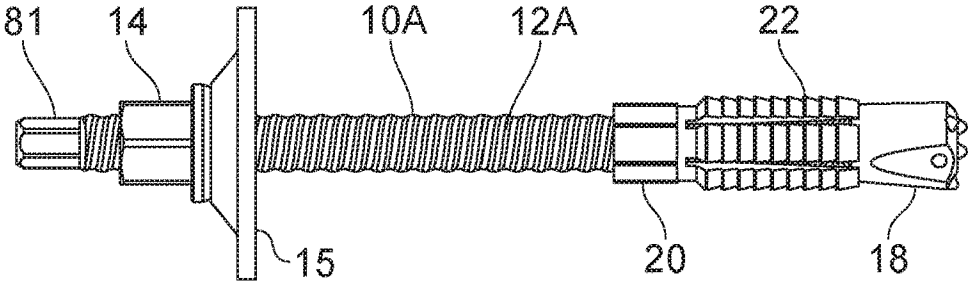
FIG. 10 shows a variant of the self-drilling rock bolt shown in FIG. 1.
Figure 11:
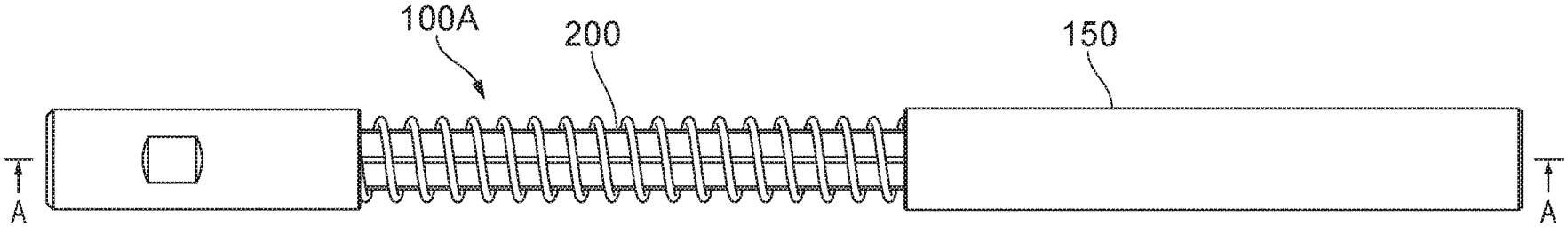
FIG. 11 shows a rock bolt dolly for use with the embodiment of FIG. 10.
Figure 11A:
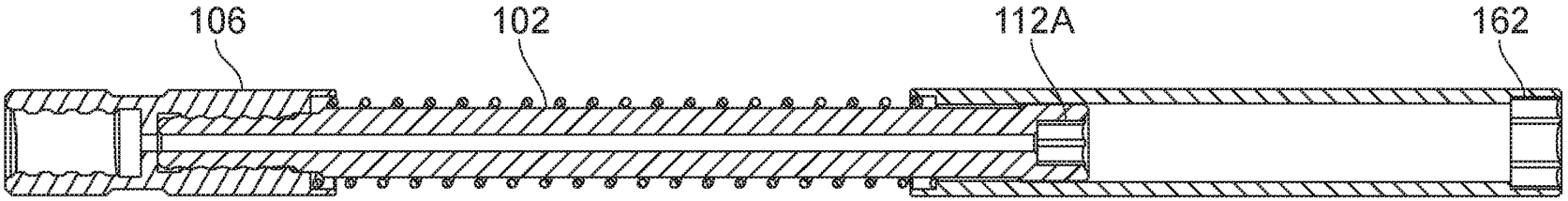
FIG. 11A shows a section on A-A shown in FIG. 11.
Figure 12:
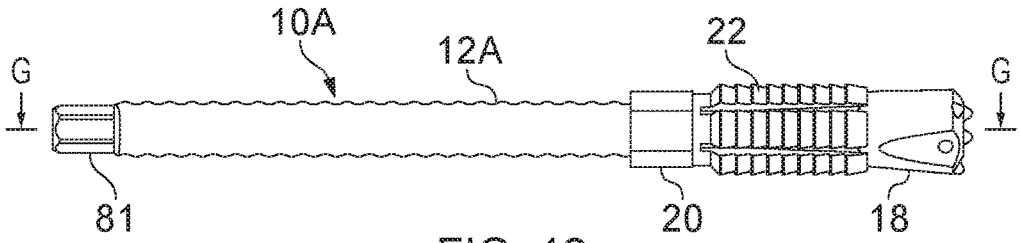
FIG. 12 shows a starter bar for use with the rock bolt dolly of FIG. 11.
Figure 13:
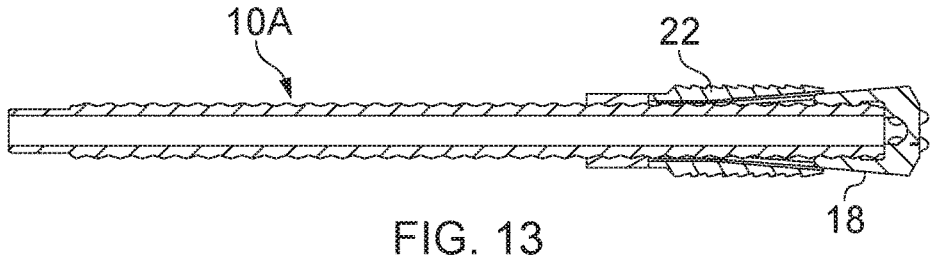
FIG. 13 shows a section on G-G shown in FIG. 12.
Figure 14:
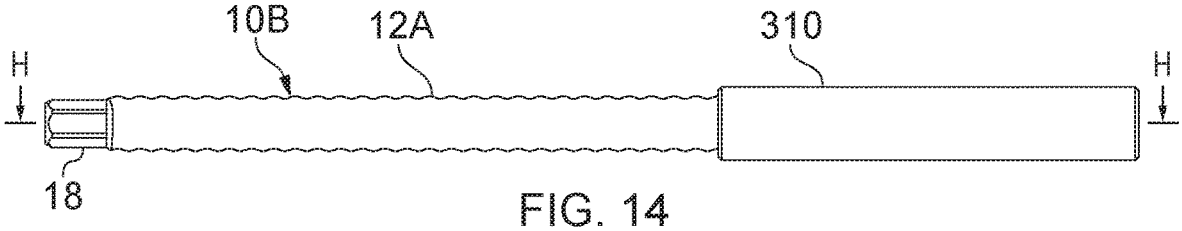
FIG. 14 shows an extension bar for use with the rock bolt dolly of FIG. 11.
Figure 15:
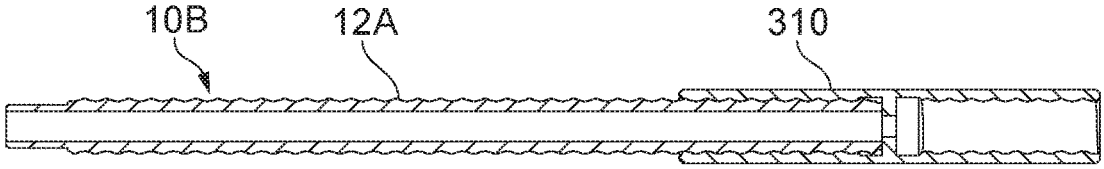
FIG. 15 shows a section on H-H shown in FIG. 14.
Figure 16:
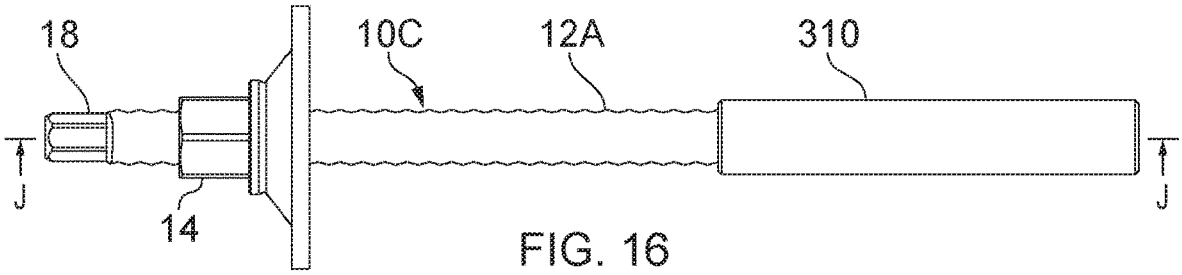
FIG. 16 shows a finisher bar for use with the rock bolt dolly of FIG. 11.
Figure 17:
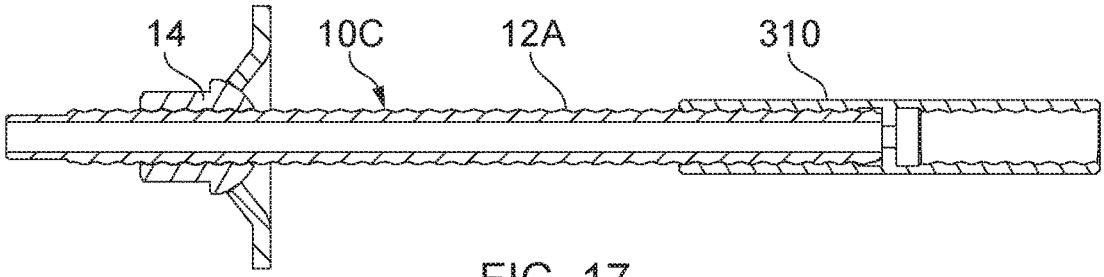
FIG. 17 shows a section on J-J shown in FIG. 16.

FIG. 10 shows a variant 10A of the rock bolt shown in FIG. 1 in which a hexagon 81 is machined into proximal end of the rod/bar 12A. If the hexagon 81 is the same size as the hexagon 82 provided on the drive adaptor 80 it can engage with the hexagonal drive socket 112 of the dolly 100. The rock bolt 10A is otherwise identical to the rock bolt 10. Typically the hexagon will be slightly smaller than the hexagon 82 provided on the drive adaptor 80 and a corresponding smaller hexagonal drive socket 112A is then provided on the dolly 100A shown in FIGS. 11 and 11A. The dolly 100A is otherwise identical to the dolly 100 and the same parts carry the same reference numerals.

The rock bolt 10A is otherwise identical to the rock bolt 10. The method of and process for installation of the bolt 10A is identical to the process of installation of the rock bolt 10 shown in FIGS. 8*a* to 9*g*.

The same dolly 100A and rock bolts 10 or 10A may be used in a variation of the installation process where a longer rock bolt is required known as extension drilling. The process for rock bolts of the type 10A is shown in FIGS. 18*a* to 19*j* which illustrates the use of the dolly 100A for extension drilling in which a bore is drilled which is longer than the rock bolt and extensions are added to create a longer rock bolt in the bore. A substantially identical process is used to install the rock bolt 10 with extensions.

FIGS. 12 to 17 show the bar components for use with extension drilling. The starter bar 10A is identical to the rock bolt 10A shown in FIG. 10, except that it does not have the hex nut 14 and bearing plate 15 mounted on the proximal end of the bar.

The extension bar 10B is a length of rod/bar 12A with a hex 81 machined on one end, being the same bar as is used for the rock bolt 10A and a coupler 310 attached on the distal end.

The finisher bar 10C is based on the same length of rod/bar 12A with a hex 81 machined on one end, and with a coupler 310 at its distal end and having a hex nut 14 and bearing plate 15 mounted on the proximal end of the bar 10B.

Figures 18A, 18B, 18C, 18D, 18E, 18F:
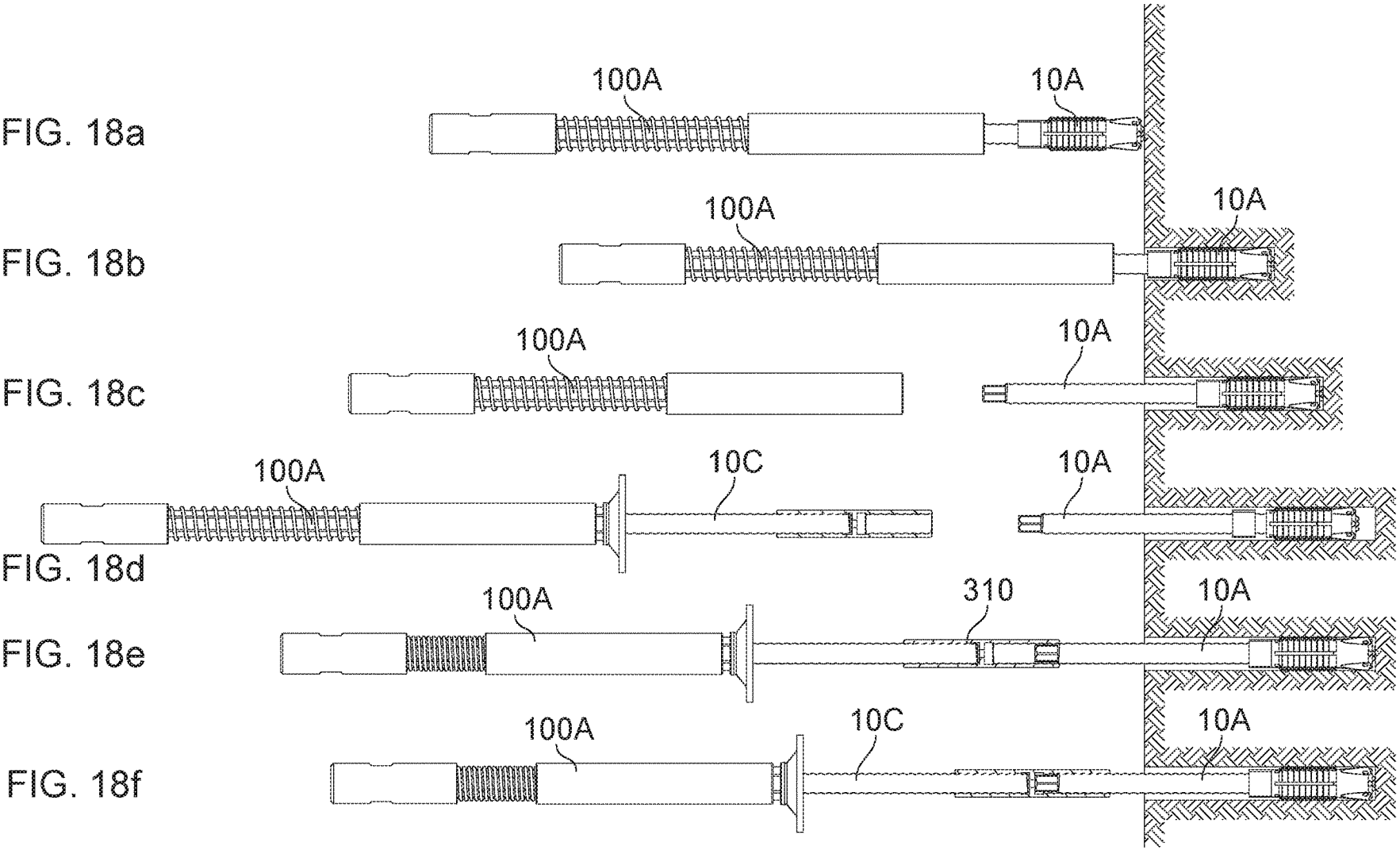
FIGS. 18*a* to 18*j* show various stages in the extension installation of the self-drilling rock bolt of FIGS. 12 and 16, using the dolly shown in FIG. 11.
Figures 19A, 19B, 19C, 19D, 19E, 19F:
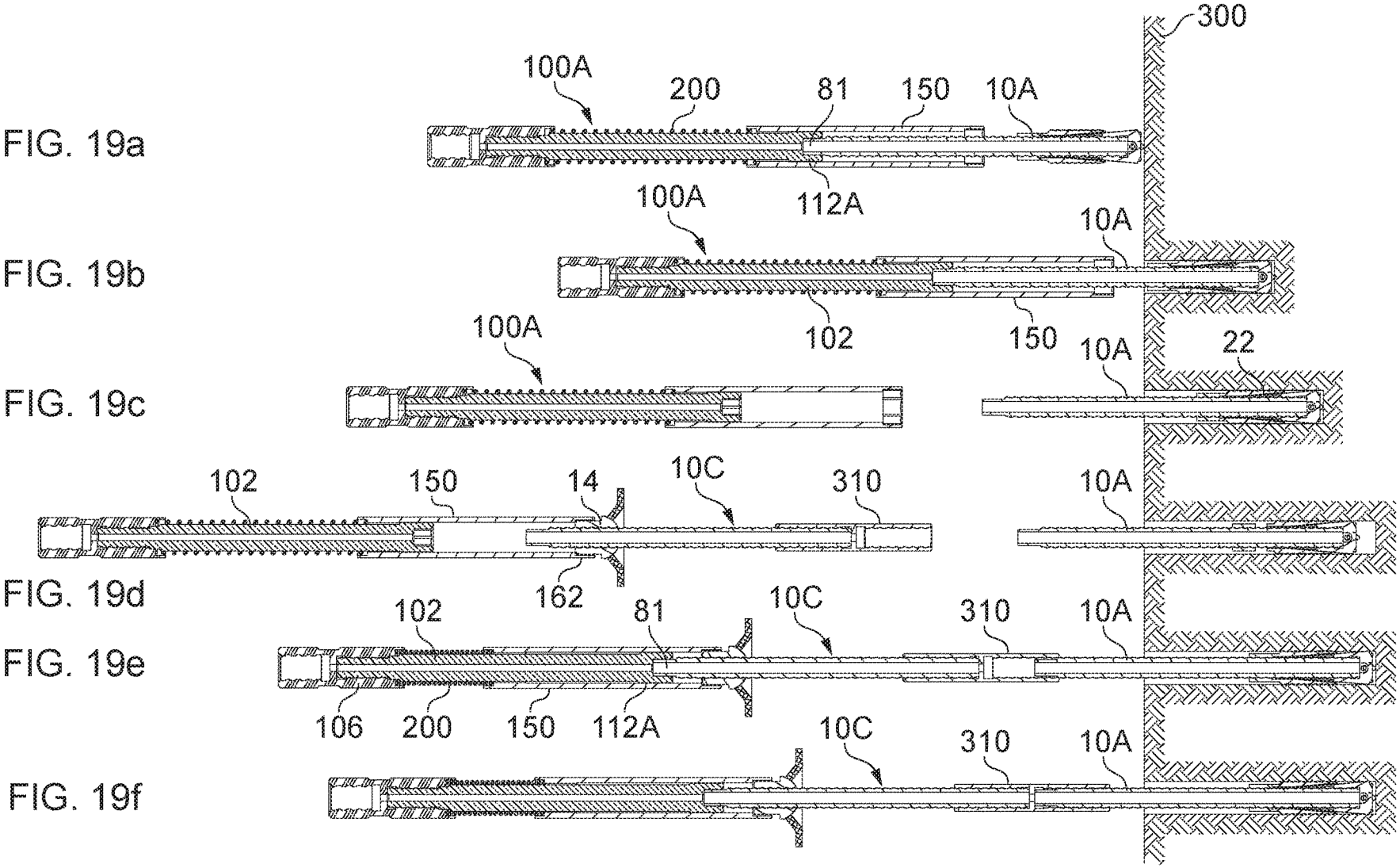
FIGS. 19*a* to 19*j* show cross-sections through the various stages shown in FIGS. 18*a* to 18*j*.

First with reference to FIGS. 18*a* and 19*a*, in a first step, the starter bar 10A is mounted to the dolly 100A, either manually or using a mechanised bolting carousel. The male hex nut 81 which is machined onto the end of the bar and inserts into the female hex socket 112A located at the front of the drive shaft portion of the dolly. It is to be noted that the biasing means/spring 200 is largely uncompressed and the sleeve 150 does not engage with the starter bar 10A.

In a second step, as shown in FIGS. 18*b* and 19*b*, the bolt 10A is then pushed against the rock face 300 where percussion and rotation (or rotation and feed pressure only) is applied to the rock bolt 10 through the engagement of the hex nut 81 with the drive shaft 102 of the dolly 100A to commence drilling the rock bolt into the rock face 300. Drilling is continued until the sleeve 150 almost touches the rock face 300.

In a third step, with reference to FIGS. 18*c* and 19*c*, drilling is then ceased and the drifter/drill motor (not shown) is retracted from the rock face. As the drill motor retracts, the dolly 100A disengages from the bolt 10A. The bolt remains inside the bore hole due to the self-engaging design of the expansion shell 22 which engages as the bolt is pulled backwards.

In a fourth step, either a finisher bar 10C or an extension bar 10B (not shown in FIG. 18 or 19) is mounted into the dolly 100A. To avoid overcomplicating the Figures, the step of installing an extension bar 10B is not shown. FIGS. 18*d* and 19*d* show a finisher bar 10C being mounted which is described with reference to the drawings, below.

In circumstances where a longer bore/rock bolt is needed one or more extension bars 10B can be used. Where an extension bar is used, a male hex nut 81 which is machined onto the proximal end of the extension bar 10B inserts into the female hex socket 112A located at the front of the drive shaft portion of the dolly. A coupler 310 is mounted on the distal end of the extension bar. The extension bar is then re-aligned with the rock bolt 10A and the coupler is screwed onto the rock bolt 10A using a combination of rotation and feed pressure. The rock bolt is then drilled into the rock face until the sleeve nears the rock face when drilling ceases. The second and third steps are repeated until the bore hole is at the required depth (allowing for the length of the finisher bar).

In the fourth step as shown in FIGS. 18*d* and 19*d* a finisher bar 10C is mounted into the dolly 100A, either manually or using a mechanised bolting carousel.

The male hex nut 14, which is threaded onto the bar and free to rotate, inserts into the female hex socket 162 located at the front of the tubular sleeve 150 of the dolly.

With reference to FIGS. 18*e* and 19*e*, in step 5, the finisher bar 10C is then re-aligned with the starter bar/rock bolt 10A or a previous extension bar and is thrust up against the bar using the drill motor feed.

The finisher bar 10C is then pushed against the rock face using the drifter/drill motor (not shown), and the drive shaft 102 is forced forward until the hexagonal socket 112A engages with the hex nut 81, as is best seen in FIG. 12*e*. The compression spring 200 is compressed between the sleeve 150 and the shank adaptor 106 which preloads the sliding outer body 150 against the hex nut 14. The exposed spring 200 provides visual feedback to the operator indicating whether the drive adaptor is properly engaged with the drive shaft or not.

Next in step 6, with reference to FIGS. 18*f* and 19*f*, once the socket 112 is engaged with the hex nut 81, drill-motor feed and pressure is used to screw the proximal end of the starter bar 10A (or extension bar) into the coupler 310.

Figures 18G, 18H, 18I, 18J:
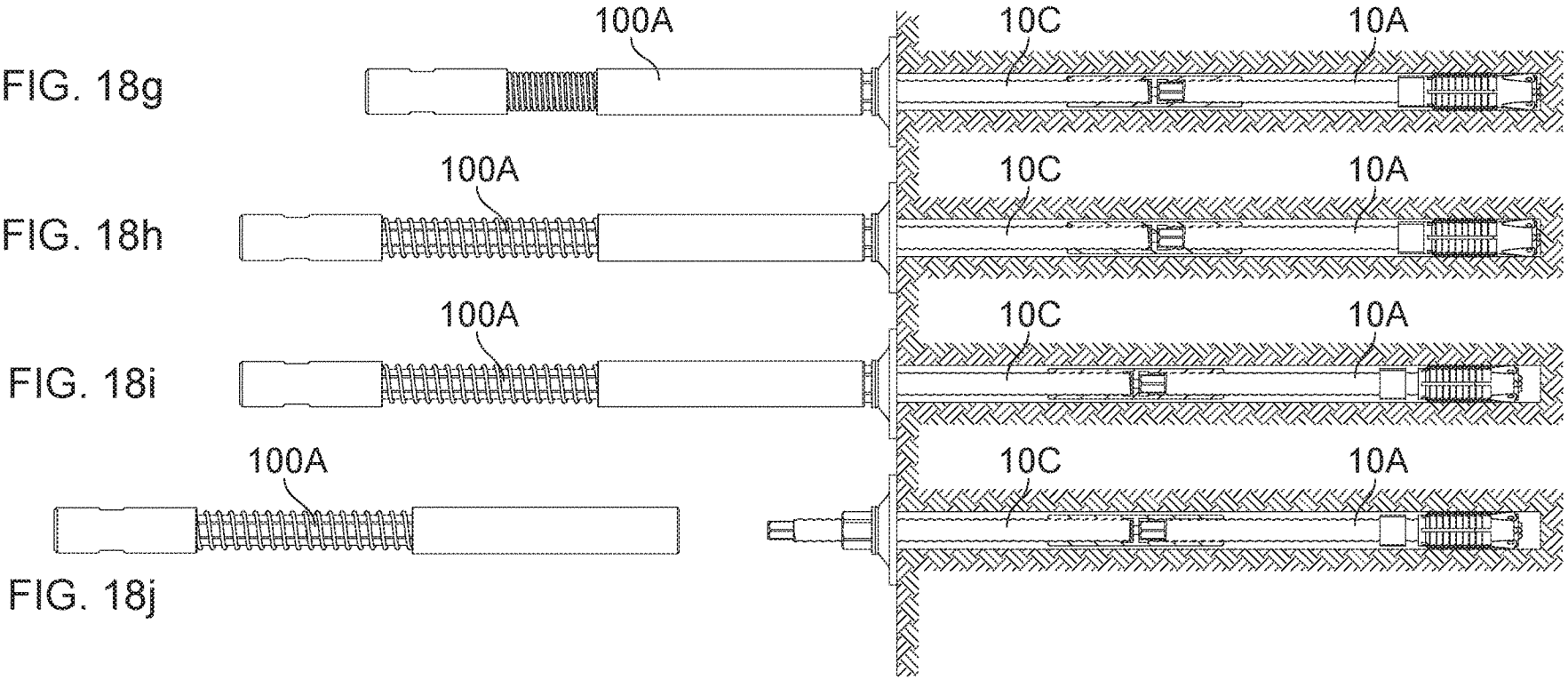
Figures 19G, 19H, 19I, 19J:
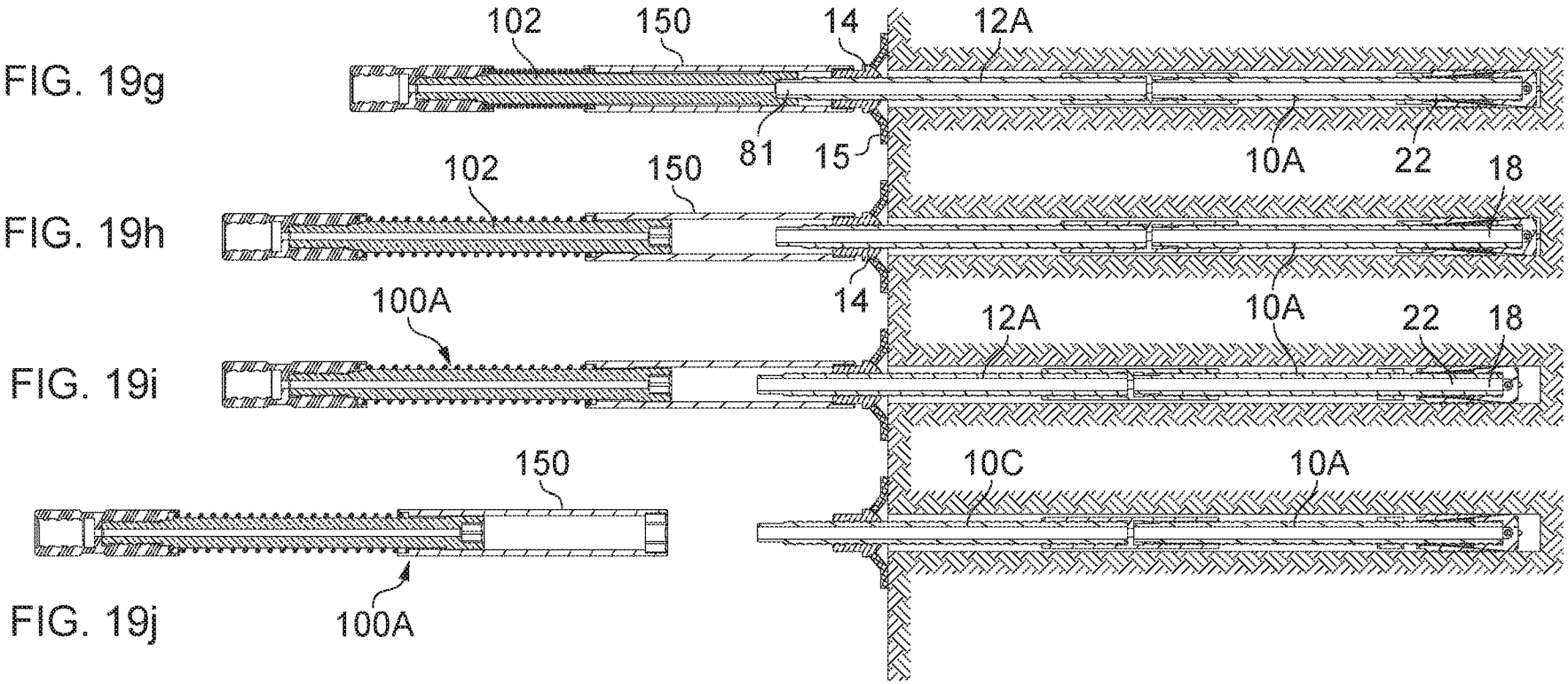

With reference to FIGS. 18*g* and 19*g*, drilling is continued and the bolt is drilled into the rock mass 300 either using a combination of percussion and rotation or just torque/rotation only. During drilling, the interlocking geometry between the sliding outer body, drive shaft and hex nut 14 restrict the hex nut 14 from translating along the bar. That is because the sleeve 150 and drive shaft 102 rotate at the same angular rotation and in turn rotate the hex nut 14 via the socket 162 and the threaded bar 12 via the hex nut 81 together at the same angular rotation. Hence the nut 14 does not translate along the rod 12, as it rotates with the rod 12. Once the bearing plate 15 encounters the rock face 300, as shown in FIG. 19*g*, drilling is stopped. During drilling, fluid is passed along the central passageway in the dolly and in the bores of the rock bolt to flush fines, and for cooling purposes.

With reference to FIGS. 18*h* and 19*h*, in step 8, the drill motor is then retracted, which causes the drive shaft 102 to disengage from the hex nut 81. During retraction, the preload from the compression spring 200 maintains engagement of the sleeve 150 and in particular the socket 162 with the hex nut 14. The operator ceases retraction of the drifter/drill motor when the drive shaft reaches its fully retracted position, shown in FIG. 19*h*. The sleeve 150 remains engaged with the hex nut 14 when the drive shaft is fully retracted.

With reference to FIGS. 18*i* and 19*i*, with the drive shaft 102 retracted and the sleeve 150 still engaged with the hex nut 14, rotation is applied to the drill motor in the same direction as drilling. This causes the socket 162 of the sleeve 150 to rotate the hex nut 14, which in turn winds along the threaded rod 12A and pulls the bolt out of the drill-hole. The act of pulling the bolt out of the drill-hole pulls the drill bit 18 towards the proximal end of the bolt 10 which in turn activates and expands the expansion shell 22 against the wall of the bore and applies tension to the bolt. Drill-motor rotation is continued until it stalls which indicates that the bolt has been tensioned. The geometry of the sleeve 150 and the drive shaft 102 allow sufficient allow sufficient clearance to prevent interference between the drive shaft and the tail end of the rock bolt as it is pulled out of the drill hole Finally as shown in FIGS. 18*j* and 19*j*, the dolly 100A is then fully retracted and grouting of the rock bolt can now occur. This can be done in any suitable way including manual attachment of a grouting implement or using a remote, push-on grouting arm that is mounted to a jumbo arm.

While the drive adaptor 80 shown in FIG. 1, is a male hexagonal drive, it will be appreciated that it could also be in the form of a female socket, in which case the hex socket 112 would be a corresponding male hex drive. The spring 200 could also be replaced by alternative biasing means such as a stack of disc springs.

Figure 20:
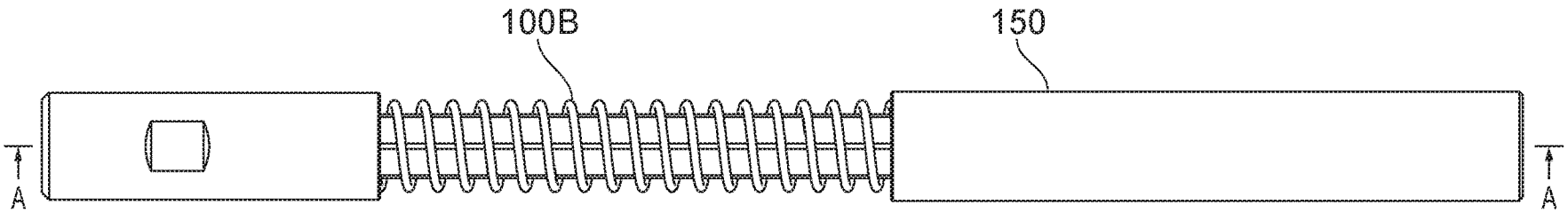
FIG. 20 shows a further variant of the dolly shown in FIGS. 2 to 7.
Figure 20A:
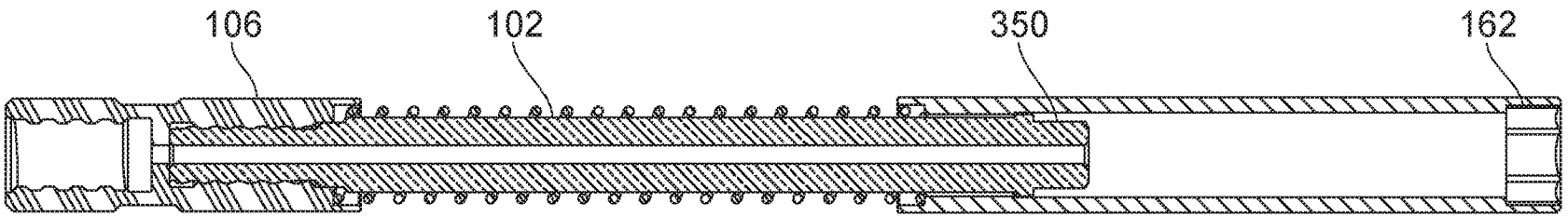
FIG. 20A is a section on A-A of FIG. 20.
Figure 21:
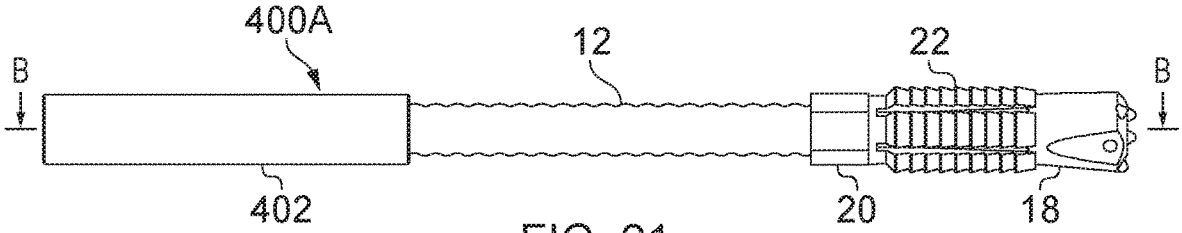
FIG. 21 shows a starter bar for use with the rock bolt dolly of FIG. 11.

FIG. 20, shows a variant in which the dolly 100B is identical to the dolly 100 except that the hex socket on the distal end of the drive shaft 102 is replaced with a male hex drive 350. FIGS. 21 to 26 show a starter bar 400A, and extension bar 400B and a finisher bar 400A for use with the dolly 100A.

Figure 22:
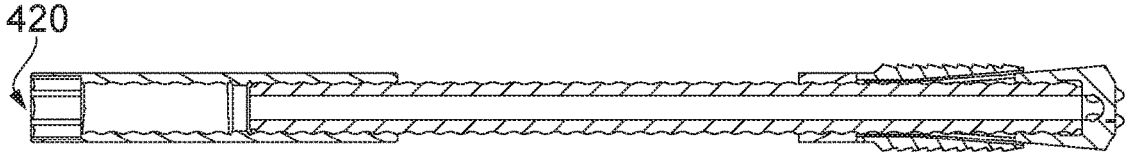
FIG. 22 shows a section on B-B shown in FIG. 21.
Figure 23:
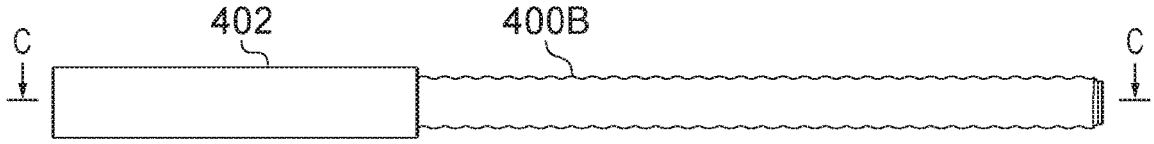
FIG. 23 shows an extension bar for use with the rock bolt dolly of FIG. 11.
Figure 24:
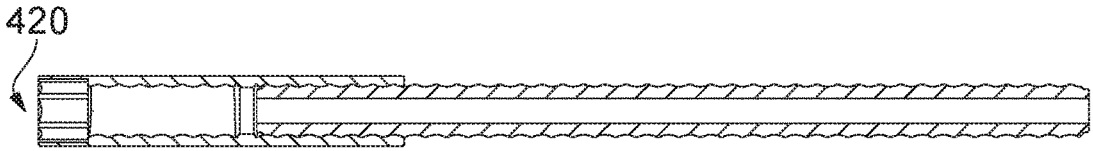
FIG. 24 shows a section on C-C shown in FIG. 23.
Figure 25:
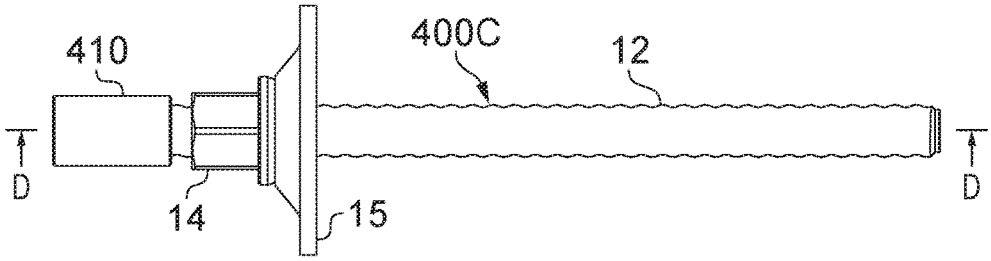
FIG. 25 shows a finisher bar for use with the rock bolt dolly of FIG. 11.
Figure 26:
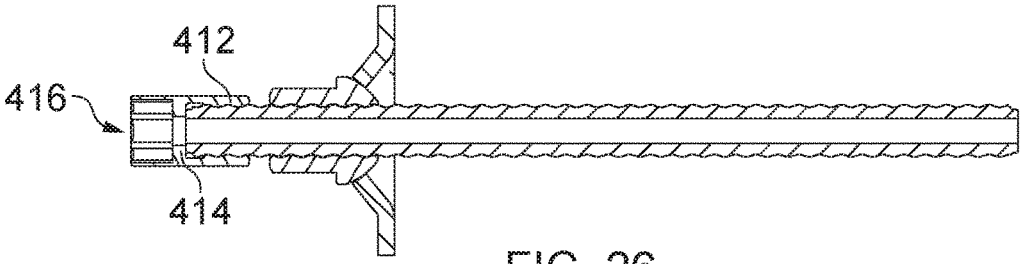
FIG. 26 shows a section on D-D shown in FIG. 25.

The starter bar 400A is the same as the rock bolt 10, shown in FIG. 1, except that it does not have the hex nut 14 and bearing plate 15 mounted on the proximal end of the bar 12 and the adaptor 80 is replaced with a coupler 402 including a female hex drive adaptor 420. As is best seen in FIG. 22, the hex drive adaptor/coupler 402 is a standard coupler but with a female hex socket 420 defined on one end of the coupler.

The extension bar 400B is a length of bar 12, with a hex drive adaptor/coupler 402 on its proximal end only.

The finisher bar 400C is a length of bar 12, with a hex drive adaptor 410 on its proximal end which defines a first bore 412 which threads onto the end of the bar 12 and defines a stop 414 and a hexagonal socket 416 on the opposite side of the stop to the bore 412. The finisher bar 400C also carries a hex nut 14 and a bearing plate 15 mounted on the proximal end of the bar adjacent the hex drive adaptor 410.

Not shown is a standard non-extension/complete rock bolt which is the same as the finisher bar 400C but including the stop 20, expansion shell 22 and drill bit 18 at its distal end—i.e. the same end as the distal end of starter bar 400A.

Installation of the bars 400A and 400C in an extension drilling process is shown in FIGS. 27*a* to 28*j*. The process is largely identical to the installation process shown in FIGS. 18*a* to 19*j*.

Figures 27A, 27B, 27C, 27D, 27E, 27F:
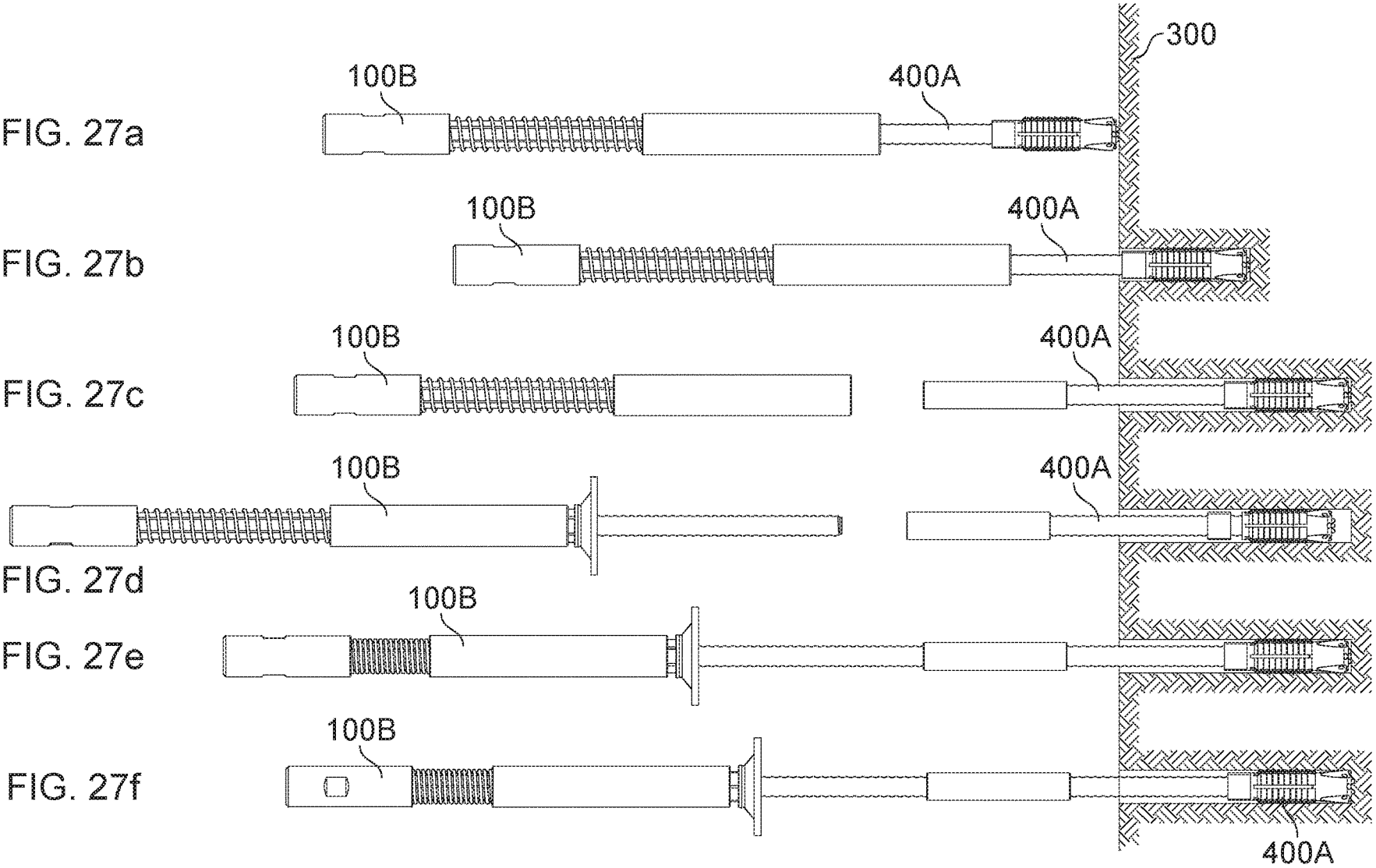
FIGS. 27*a* to 27*j* show various stages in the installation of the self-drilling rock bolt of FIGS. 21 and 25, using the dolly shown in FIG. 11.
Figures 28A, 28B, 28C, 28D, 28E, 28F:
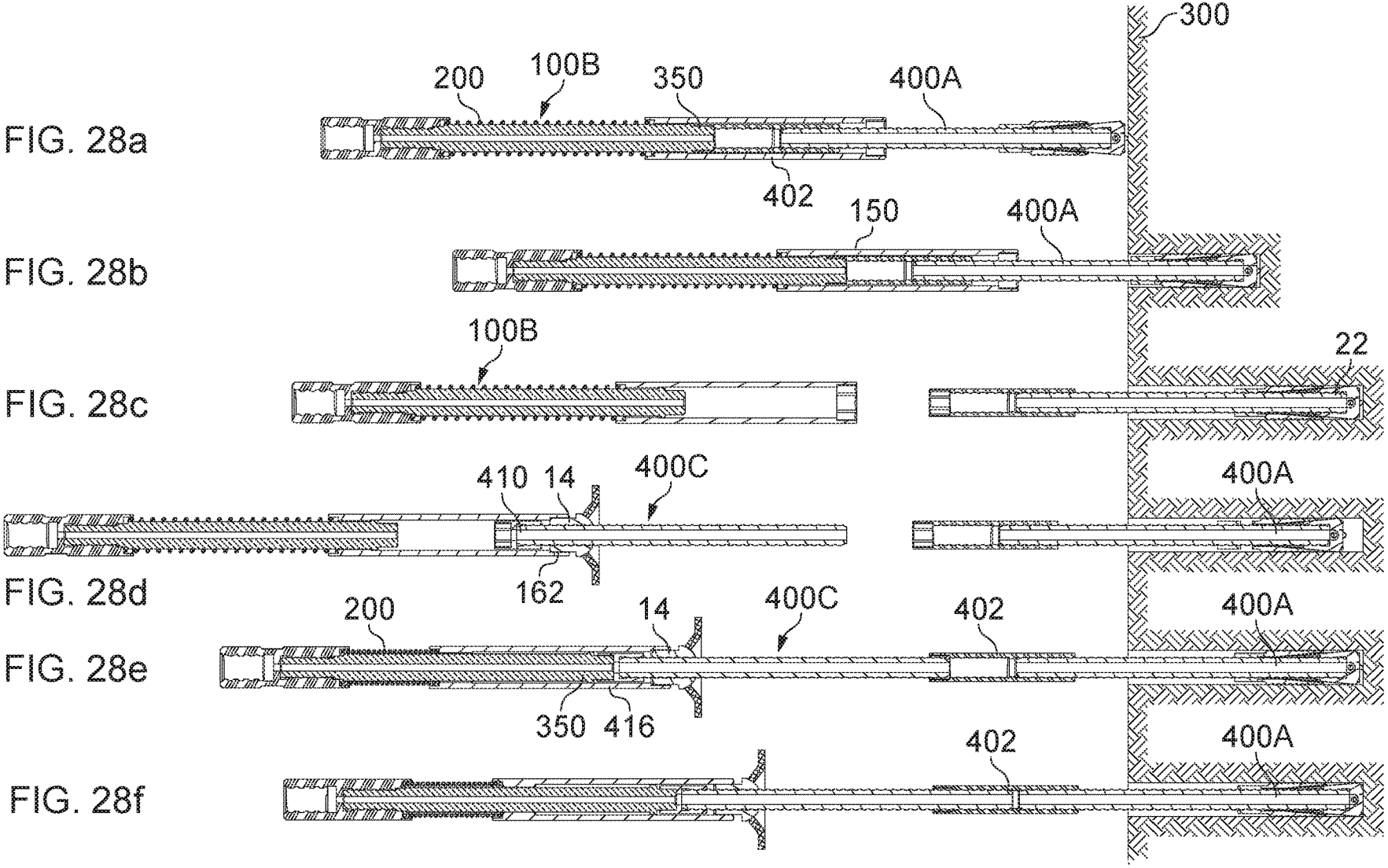
FIGS. 28*a* to 28*j* show cross-sections through the various stages shown in FIGS. 18*a* to 18*j*.

In a first step, with reference to FIGS. 27*a* and 28*a*, the starter bar 400A is mounted to the dolly 100B, either manually or using a mechanised bolting carousel. The male hex drive 350 located at the front of the drive shaft portion of the dolly inserts into the female hex socket 420 of the coupler 402. It is to be noted that the biasing means/spring 200 is largely uncompressed and the sleeve 150 does not engage with the starter bar 400A.

In a second step, as shown in FIGS. 27*b* and 28*b*, the bolt 400A is then pushed against the rock face 300 where percussion and rotation (or rotation and feed pressure only) is applied to the rock bolt 10 through the engagement of the hex socket 420 with the drive shaft 102 of the dolly 100B to commence drilling the rock bolt into the rock face 300. Drilling is continued until the sleeve 150 almost touches the rock face 300.

In a third step, with reference to FIGS. 27*c* and 28*c*, drilling is then ceased and the drifter/drill motor (not shown) is retracted from the rock face 300. As the drill motor retracts the dolly 100B disengages from the bolt 400A. The bolt remains inside the bore hole due to the self-engaging design of the expansion shell 22 which engages as the bolt is pulled backwards.

In the fourth step as shown in FIGS. 27*d* and 28*d* a finisher bar 400C is mounted into the dolly 100B, either manually or using a mechanised bolting carousel. (The option of installing an extension bar 400B is not shown, however it is essentially the same process as in the earlier extension drilling process, described above with reference to FIGS. 18*a* to 19*j*). The male hex nut 14, which is threaded onto the bar and free to rotate, inserts into the female hex socket 162 located at the front of the tubular sleeve 150 of the dolly 100B.

With reference to FIGS. 27*e* and 28*e*, in step 5, the finisher bar 400C is then re-aligned with the starter bar/rock bolt 400A or a previous extension bar and is thrust up against the bar 400A using the drill motor feed.

The finisher bar 400C is then pushed against the rock face using the drifter/drill motor (not shown), and the drive shaft 102 is forced forward until the hex drive 350 engages with the female hex socket 416 of the hex drive adaptor 410, as is best seen in FIG. 28*e*. The compression spring 200 is compressed between the sleeve 150 and the shank adaptor 106 which preloads the sliding outer body 150 against the hex nut 14.

Next in step 6, with reference to FIGS. 27*f* and 28*f*, once the hex drive 350 is engaged with the hex socket 416, drill-motor feed and pressure is used to screw the proximal end of the finisher bar 400C (or extension bar) into the coupler 402.

Figures 27G, 27H, 27I, 27J:
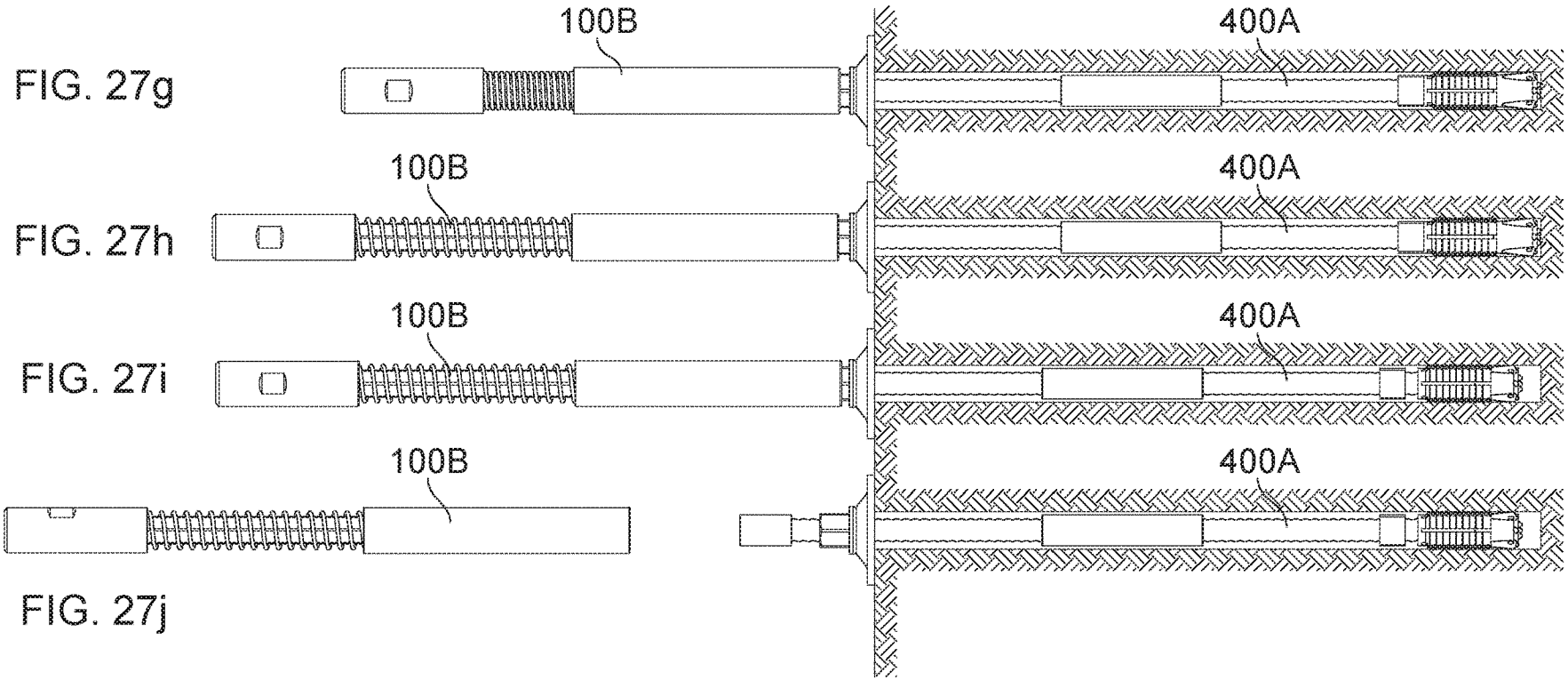
Figures 28G, 28H, 28I, 28J:
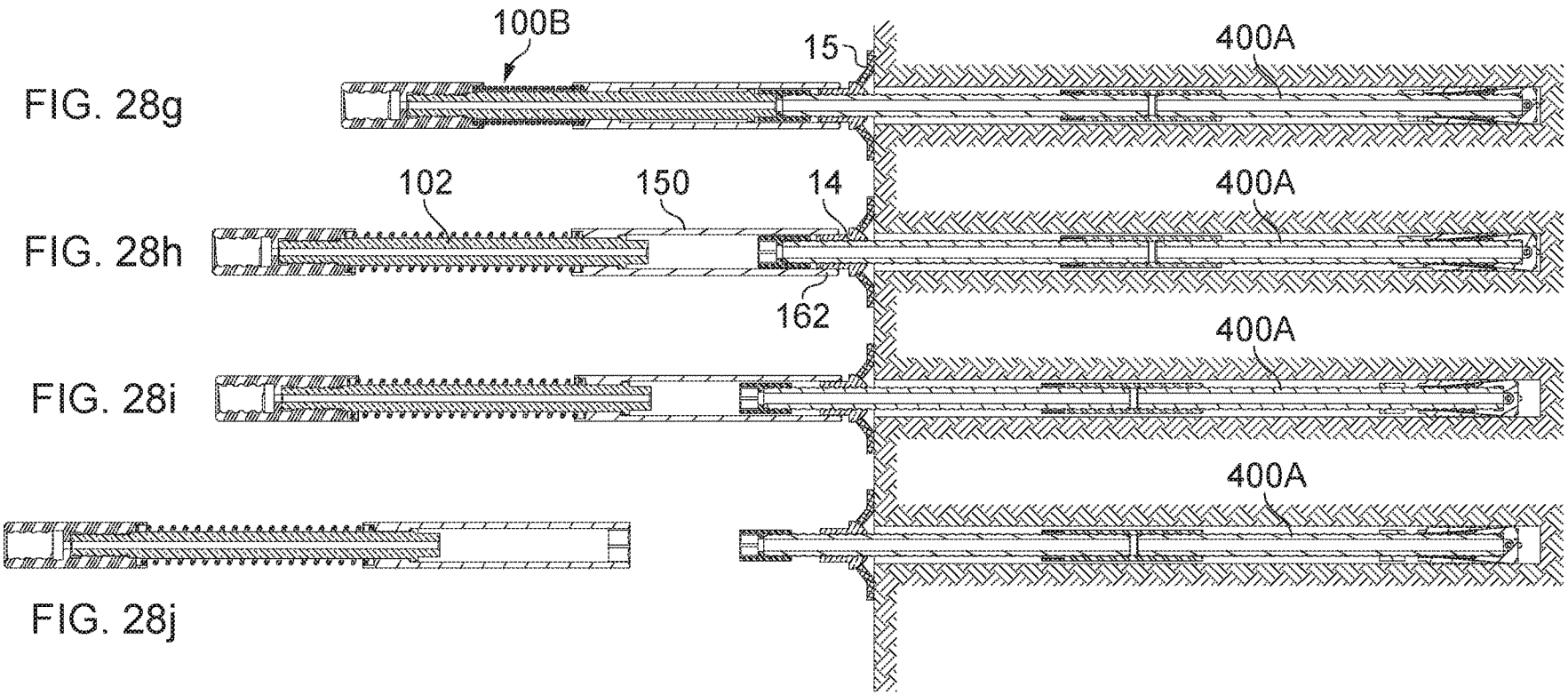

With reference to FIGS. 27*g* and 28*g*, drilling is continued and the bolt is drilled into the rock mass 300 either using a combination of percussion and rotation or just torque/rotation only. During drilling, the interlocking geometry between the sliding outer body, drive shaft and hex nut 14 restrict the hex nut 14 from translating along the bar. That is because the sleeve 150 and drive shaft 102 rotate at the same angular rotation and in turn rotate the hex nut 14 via the socket 162 and the threaded bar 12 via the hex adaptor 410 together at the same angular rotation. Hence the nut 14 does not translate along the rod 12, as it rotates with the rod 12. Once the bearing plate 15 encounters the rock face 300, as shown in FIG. 27*g*, drilling is stopped. During drilling, fluid is passed along the central passageways in the dolly 100B and in the bores of the rock bolt 12 to flush fines out, and for cooling purposes.

With reference to FIGS. 27*h* and 28*h*, in step 8, the drill motor is then retracted, which causes the drive shaft 102/hex drive 350 to disengage from the hex socket 416 and drive adaptor 410. During retraction, the preload from the compression spring 200 maintains engagement of the sleeve 150 and in particular the socket 162 with the hex nut 14. The operator ceases retraction of the drifter/drill motor when the drive shaft reaches its fully retracted position, shown in FIG. 28*h*. The sleeve 150 remains engaged with the hex nut 14 when the drive shaft is fully retracted.

With reference to FIGS. 27*i* and 28*i*, with the drive shaft 102 retracted and the sleeve 150 still engaged with the hex nut 14, rotation is applied to the drill motor in the same direction as drilling. This causes the socket 162 of the sleeve 150 to rotate the hex nut 14, which in turn winds along the threaded rod 12 and pulls the bolt out of the drill-hole. The act of pulling the bolt out of the drill-hole pulls the drill bit 18 towards the proximal end of the bolt 10 which in turn activates and expands the expansion shell 22 against the wall of the bore and applies tension to the bolt. Drill-motor rotation is continued until it stalls which indicates that the bolt has been tensioned. The geometry of the sleeve 150 and the drive shaft 102 allow sufficient allow sufficient clearance to prevent interference between the drive shaft and the tail end of the rock bolt as it is pulled out of the drill hole Finally as shown in FIGS. 18*j* and 19*j*, the dolly 100B is then fully retracted and grouting of the rock bolt can now occur. This can be done in any suitable way including manual attachment of a grouting implement or using a remote, push-on grouting arm that is mounted to a jumbo arm.

It will be appreciated that the dolly may be used for other types of self-drilling rock bolts than the bolt shown in Australian innovation patent AU2021105904.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A rock bolt dolly for connecting a self-drilling rock bolt to a rock bolting apparatus, such as a drifter, rock drill or the like, and arranged to transfer torque applied to the dolly by the rock bolting apparatus to the rock bolt during installation of the rock bolt, the rock bolt comprising an externally threaded rod having a proximal end and a distal end defining a drill bit, the dolly defining a coupling means at its proximal end for engagement with the rock bolting apparatus, the dolly further comprising:

a drive shaft defining a proximal end and a distal end, the drive shaft defining an engagement means at the distal end for engagement with a corresponding engagement means located on or defined at the proximal end of the rock bolt;

a sleeve mounted over the distal end of the drive shaft and arranged to slide along and over the drive shaft and defining a female engagement means at a distal end, for engaging with a nut or the like threaded onto the proximal end of the rock bolt, the interior of the sleeve and exterior of the drive shaft being configured such that the drive shaft and sleeve rotate together about their central axis, and a biasing means for biasing the distal end of the sleeve away from the distal end of the drive shaft;

the arrangement being such that in a first mode, with the biasing means compressed, the engagement means of the drive shaft is engaged with the corresponding engagement means located on or defined on the proximal end of the rock bolt, and the female engagement means of the sleeve is engaged with the nut or the like threaded onto the proximal end of the rock bolt so that the dolly rotates the rod and nut together such that the nut does not translate along the rod, and in a second mode, with the biasing means expanded, the engagement means of the drive shaft is disengaged from the corresponding engagement means and the female engagement means of the sleeve is engaged with the nut or the like and the dolly rotates the nut only which translates along the externally threaded rod of the rock bolt.

2. The rock bolt dolly as claimed in claim 1, wherein the exterior of the main body portion of the drive shaft is polygonal, preferably hexagonal, and the sleeve defines a correspondingly shaped polygonal aperture in which the main body portion locates and can slide.

3. The rock bolt dolly as claimed in claim 1, wherein a bore extends through the dolly including through the drive shaft to allow the passage of fluids such as water for flushing fines, liquid grout or the like through the dolly.

4. The rock bolt dolly as claimed in claim 1, wherein the biasing means comprises a spring, typically a compression spring.

5. The rock bolt dolly as claimed in claim 1, wherein the engagement means defined at the distal end of the drive shaft is a hexagonal socket.

6. The rock bolt dolly as claimed in claim 1, wherein the corresponding engagement means located on or defined on the proximal end of the rock bolt comprise an adaptor mounted on the proximal end of the rock bolt defining a hex drive.

7. The rock bolt dolly as claimed in claim 1, wherein the corresponding engagement means located on or defined on the proximal end of the rock bolt comprise a hex drive machined onto the rod of the rock bolt.

8. The rock bolt dolly as claimed in claim 1, wherein the engagement means at the distal end of the drive shaft is hexagonal drive and the corresponding engagement means located on or defined on the proximal end of the rock bolt comprises a hexagonal socket formed in an adaptor mounted onto the end of the rod of the rock bolt.

9. A method of installing a self-drilling rock bolt in a rock face, using a rock bolt dolly as claimed in claim 1, in a rock face, the method comprising the steps of:

providing a rock bolt comprising:

an elongate rod having a first or distal end and a second or proximal end;

a drill bit mounted on the distal end for drilling a bore in strata such as rock or the like;

an engagement means for rotating the elongate rod fixed on or defined at a proximal end of the rock bolt, and being fixed to the rod such that rotation of the engagement means causes rotation of the elongate rod; and a nut threaded onto the proximal end of the rock bolt;

mounting the rock bolt to the rock bolt dolly;

inserting the nut or the like threaded onto the proximal end of the rock bolt into the female engagement means of the sleeve;

pushing the distal end of the rock bolt defining a drill bit against the rock face until, with the biasing means compressed, the engagement means of the drive shaft is engaged with the corresponding engagement means defined at the proximal end of the rock bolt;

applying rotation to the rock bolt dolly to drill the rock bolt into the rock face using the drill bit rotating both the nut and the elongate rod of the rock bolt;

terminating drilling after a bearing plate located on the proximal end of the rock bolt contacts the rock face;

retracting the rock bolting apparatus to disengage the engagement means of the drive shaft from the corresponding engagement means located on or defined on the proximal end of the rock bolt; and with the nut or the like threaded onto the proximal end of the rock bolt still engaged with the female engagement means of the sleeve, rotating the dolly, in the same direction as during drilling, to rotate the nut along the rod of the rock bolt which pulls the distal end of the rock bolt back towards the rock face/bearing plate and causes the expansion shell of the rock bolt to expand and tension is applied to the rock bolt.

10. The method as claimed in claim 9, comprising the step retracting the rock bolt dolly and post-grouting the rock-bolt after tensioning.

11. A method of installing a self-drilling rock bolt using a rock bolt dolly as claimed in any claim 1 in a rock face, in an extension drilling process, comprising the steps of:

a) mounting a starter rock bolt to the rock bolt dolly, the starter rock bolt comprising:

an elongate rod having a central bore and being externally threaded, the rod having a first or distal end and a second or proximal end;

a drill bit mounted on the distal end for drilling a bore in strata such as rock or the like wherein the sides of the drill bit taper outwardly towards the cutting end of the drill at an angle of from about 1 to 10°, preferably about 5°;

an expansion shell mounted about the exterior of the rod adjacent the drill bit, the shell defining at least one longitudinal slot to allow the shell to expand and contract;

a stop for maintaining the expansion shell in close proximity to the drill bit and limiting the movement of the expansion shell towards the proximal end of the rock bolt;

wherein the exterior of the shell is contoured to define a series of ridges or the like and wherein the widest part of the shell is wider than the drill bit and wherein the interior of the shell is wider than the exterior of the elongate rod to allow the rod to rotate relative to the shell and wherein the shell is free to rotate relative to the drill bit, and is tapered inwardly towards the proximal end; and an engagement means for rotating the elongate rod located on or defined at or near a proximal end of the rock bolt, corresponding to the engagement means defined on the distal end of the drive shaft; wherein the step of mounting comprises engaging the corresponding engagement means of the starter bar with the engagement means defined on the distal end of the drive shaft;

b) pushing the drill bit of the starter rock bolt against the rock face and applying rotation to the rock bolt dolly to drill the rock bolt into the rock face using the drill bit;

c) terminating drilling after the sleeve of the dolly nears the rock face;

d) retracting the rock bolting apparatus to disengage the engagement means of the drive shaft from the corresponding engagement means located on or defined on the proximal end of the starter rock bolt;

e) mounting either an extension bar having a coupler mounted on the distal end of the extension bar, or a finisher bar, to the dolly;

f) optionally, where an extension bar is used, engaging an engagement means for rotating the extension bar located on or defined at or near a proximal end of the extension bar, with the engagement means defined on the distal end of the drive shaft, aligning the extension bar with the starter bar or a previous extension bar connecting the bars using the coupler, and drilling the rock bolt further into the rock face using a combination of rotation and feed pressure and terminating drilling after the sleeve of the dolly nears the rock face;

g) optionally repeating step f) one or more times with one or more further extension bars;

h) mounting a finisher bar to the rock bolt dolly, the finisher bar comprising an engagement means for rotating the elongate rod of the finisher bar located on or defined at or near a proximal end of the rock bolt, corresponding to the engagement means defined on the distal end of the drive shaft; wherein the step of mounting comprises engaging the corresponding engagement means of the starter bar with the engagement means defined on the distal end of the drive shaft, the finisher bar also comprising a nut or the like threaded onto the proximal end of the rock bolt which is inserted into the female engagement means of the sleeve and further defining a coupler on its distal end;

i) aligning the finisher bar with the starter bar or a previous extension bar, connecting the bars using the coupler and drilling the rock bolt further into the rock face using a combination of rotation and feed pressure and terminating drilling after the sleeve of the dolly or bearing plate associated with the nut nears the rock face;

j) disengaging the drive shaft from the finisher bar; and h) with the nut or the like threaded onto the proximal end of the finisher bar still engaged with the female engagement means of the sleeve, rotating the dolly, in the same direction as during drilling, to rotate the nut along the rod of the finisher bar which pulls the distal end of the starter bar back towards the rock face/bearing plate and causes the expansion shell of the starter bar to expand and tension to be applied to the rock bolt.

12. A rock bolt comprising:

an elongate rod having a central bore and being externally threaded, the rod having a first or distal end and a second or proximal end;

a drill bit mounted on the distal end for drilling a bore in strata such as rock or the like wherein the sides of the drill bit taper outwardly towards the cutting end of the drill at an angle of from about 1 to 10°, preferably about 5°;

an expansion shell mounted about the exterior of the rod adjacent the drill bit, the shell defining at least one longitudinal slot to allow the shell to expand and contract;

a stop for maintaining the expansion shell in close proximity to the drill bit and limiting the movement of the expansion shell towards the proximal end of the rock bolt;

wherein the exterior of the shell is contoured to define a series of ridges or the like and wherein the widest part of the shell is wider than the drill bit and wherein the interior of the shell is wider than the exterior of the elongate rod to allow the rod to rotate relative to the shell and wherein the shell is free to rotate relative to the drill bit, and is tapered inwardly towards the proximal end;

a nut threadably engaged on the rod at the proximal end of the rod, such that rotation of the nut relative to the rod translates the nut along the rod;

an engagement means for rotating the elongate rod fixed on or defined at a proximal end of the rock bolt, and being fixed to the rod such that rotation of the engagement means causes rotation of the elongate rod;

the arrangement being such that as the rock bolt is installed in strata, in a first mode both the nut and the elongate rod may be rotated together at the same angular velocity such that the nut does not translate along the rod and the drill bit forms a bore in the strata and the shell tends to drag along the bore wall when thrust forward during drilling and remains largely clear of the spinning rod and drill bit and when drilling ceases, and only the nut is rotated causing movement of the rock bolt out from the bore and causes the drill bit to engage with and expand the shell.

13. The rock bolt as claimed in claim 12, wherein the corresponding engagement means located on or defined on the proximal end of the rock bolt comprise an adaptor mounted on the proximal end of the rock bolt, typically defining a hex drive.

14. The rock bolt as claimed in claim 12, wherein the corresponding engagement means located on or defined on the proximal end of the rock bolt comprise a male hex drive machined onto or into the proximal end of the rod of the rock bolt.

15. The rock bolt as claimed in claim 12, wherein the corresponding engagement means located on or defined on the proximal end of the rock bolt comprise an adaptor mounted on the proximal end of the rock bolt, typically defining a hex socket.

16. A rock bolt dolly for connecting a self-drilling rock bolt to a rock bolting apparatus and arranged to transfer torque applied to the dolly by the rock bolting apparatus to the rock bolt during installation of the rock bolt, the rock bolt including an externally threaded rod having a proximal end and a distal end defining a drill bit, the dolly defining a coupling means at its proximal end for engagement with the rock bolting apparatus, the dolly further comprising:

a drive shaft having a central bore for the transmission of fluids for flushing fines and/or cooling during drilling, and defining a proximal end and a distal end, the drive shaft defining an engagement means at the distal end for engagement with a corresponding engagement means located on or defined at the proximal end of the rock bolt;

a housing mounted around the distal end of the drive shaft and arranged to slide relative to the drive shaft and defining a female engagement means at a distal end, for engaging with a nut or the like threaded onto the proximal end of the rock bolt, the interior of the sleeve and exterior of the drive shaft being configured such that the drive shaft and sleeve rotate together about their central axis, and a biasing means for biasing the distal end of the sleeve away from the distal end of the drive shaft;

the arrangement being such that in a first mode, with the biasing means compressed, the engagement means of the drive shaft is engaged with the corresponding engagement means located on or defined on the proximal end of the rock bolt, and the female engagement means of the sleeve is engaged with the nut or the like threaded onto the proximal end of the rock bolt so that the dolly rotates the rod and nut together such that the nut does not translate along the rod, and in a second mode, with the biasing means expanded, the engagement means of the drive shaft is disengaged from the corresponding engagement means and the female engagement means of the sleeve is engaged with the nut or the like and the dolly rotates the nut only which translates along the externally threaded rod of the rock bolt.

17. The rock bolt dolly as claimed in claim 16, wherein the biasing means comprises a compression spring.

18. A rock bolt comprising:

an elongate rod having a central bore and being externally threaded, the rod having a first or distal end and a second or proximal end;

a drill bit mounted on the distal end for drilling a borehole in strata such as rock or the like wherein the sides of the drill bit taper outwardly towards the cutting end of the drill;

an expansion shell located adjacent the drill bit, a nut threadably engaged on the rod at the proximal end of the rod, such that rotation of the nut relative to the rod translates the nut along the rod; and an engagement means for rotating the elongate rod fixed on or defined at a proximal end of the rock bolt, and being fixed to the rod such that rotation of the engagement means causes rotation of the elongate rod;

the arrangement being such that as the rock bolt is installed in strata, in a first mode by engaging both the nut and the engagement means, both the nut and the elongate rod may be rotated together at the same angular velocity such that the nut does not translate along the rod and the drill bit forms a bore in the strata and when drilling ceases, and only the nut is rotated causing movement of the rock bolt out from the bore and causes the drill bit to engage with and expand the expansion shell to anchor the distal end of the rock bolt in the borehole.

19. The rock bolt as claimed in claim 18, wherein the engagement means is a male engagement means.

* * * * *